US005747922A

United States Patent [19]

Sukeno et al.

[11] Patent Number: 5,747,922

[45] Date of Patent: May 5, 1998

[54] COLOR PICTURE TUBE AND IN-LINE ELECTRON GUN WITH FOCUSING ELECTRODES HAVING ELONGATED THROUGH HOLES

[75] Inventors: Masahiko Sukeno, Hyogo; Yasuyuki Ueda, Osaka, both of Japan

[73] Assignee: Matsushita Electronics Corporation, Osaka, Japan

[21] Appl. No.: 861,910

[22] Filed: May 22, 1997

Related U.S. Application Data

[63] Continuation of Ser. No. 517,314, Aug. 21, 1995, abandoned.

[30] Foreign Application Priority Data

Aug. 23, 1994 [JP] Japan ..... 6-197102
Oct. 12, 1994 [JP] Japan ..... 6-245745

[51] Int. Cl.[6] ..... H01J 29/50; H01J 29/70

[52] U.S. Cl. ..... 313/412; 313/414; 313/427

[58] Field of Search ..... 313/412–417, 313/427, 452, 460, 428, 432, 439; 315/14, 15, 384–85

[56] References Cited

U.S. PATENT DOCUMENTS

| | | | |
|---|---|---|---|
| 4,814,670 | 3/1989 | Suzuki et al. | 315/15 |
| 4,886,999 | 12/1989 | Yamane et al. | 313/414 |
| 5,061,881 | 10/1991 | Suzuki et al. | 313/414 X |
| 5,281,892 | 1/1994 | Kweon et al. | 313/414 |
| 5,300,855 | 4/1994 | Kweon | 313/414 |
| 5,434,471 | 7/1995 | Jeong | 313/414 |

FOREIGN PATENT DOCUMENTS

| | | |
|---|---|---|
| 0 241 218 | 10/1987 | European Pat. Off. . |
| 25 37 979 | 3/1977 | Germany . |
| 36 14 700 | 11/1986 | Germany . |
| 38 39 389 | 6/1989 | Germany . |
| 62-237642 | 10/1987 | Japan . |
| 2 236 613 | 4/1991 | United Kingdom . |
| 2 240 212 | 7/1991 | United Kingdom . |
| 2 274 020 | 7/1994 | United Kingdom . |

OTHER PUBLICATIONS

Copy of European Search Report dated Jan. 9, 1996.

"An In–Line Color CRT With Dynamic Beam Shaping For Data Display," H. Yamane et al., *Proceedings of the Society for Information Display (SID)*, vol. 29, No. 1, 1988, pp. 41–45.

JP–A–06 068812 (11 Mar. 1994), *Patent Abstracts of Japan*, vol. 18, No. 308, 13 Jun. 1994.

*Primary Examiner*—Sandra L. O'Shea
*Assistant Examiner*—Mack Haynes
*Attorney, Agent, or Firm*—Merchant, Gould, Smith, Edell, Welter & Schmidt, P.A.

[57] ABSTRACT

In a color picture tube having a wide and flat screen, one set of in-line three electron beam through holes on an end face of a first focusing electrode facing a second focusing electrode are formed with a vertically oblong rectangular shape, and the other set of in-line three electron beam through holes on an end face of the second focusing electrode facing the first focusing electrode are formed with a horizontally oblong rectangular shape, a pair of protrusions is provided on a pair of longer sides of each of the electron beam through holes. Therefore, intensive quadrupole fields, by which deflection distortion can be cancelled, can be generated. Fluctuation of the quadrupole fields due to interference of a dynamic voltage and focusing voltage, which are to be applied to the focusing electrodes, can be prevented.

14 Claims, 22 Drawing Sheets

COLOR PICTURE TUBE AND IN-LINE ELECTRON GUN WITH FOCUSING ELECTRODES HAVING ELONGATED THROUGH HOLES

This is a Continuation of application Ser. No. 08/517,314, now abandoned filed Aug. 21, 1995.

FIELD OF THE INVENTION

This invention relates to a color picture tube in which a high resolution picture image can be displayed in a whole region of a screen, and relates to an in-line electron gun which is suitable for the color picture tube.

DESCRIPTION OF THE PRIOR ART

In an in-line color picture tube, three cathodes are arranged on a horizontal line and a deflection yoke for self-convergence is mounted. The deflection yoke generates an uneven deflection magnetic field which is a combination of a horizontal deflection field distorted as a pincushion shape and a vertical deflection field distorted as a barrel shape. Thus, three electron beams, for emitting red, green and blue, are converged at a predetermined point on a phosphor screen. The uneven deflection magnetic field, however, distorts the three electron beams which pass through the deflection magnetic field, so that beam spots focused at a peripheral portion of the phosphor screen are distorted as non-circular. Therefore, it is impossible to obtain a high resolution picture image at the peripheral portion on the phosphor screen by simply generating the uneven deflection magnetic field.

A method for cancelling the distortion of the electron beams due to the deflection magnetic field is proposed. In the method, a distortion, which is negative to the distortion due to the deflection magnetic field, is applied to each of the three electron beams by a quadrupole field prior to the three electron beams passing through the deflection magnetic field.

In a first conventional in-line electron gun for a conventional color picture tube, for example, shown in Publication Gazette of Unexamined Japanese Patent Application Sho 62-237642, quadrupole fields are respectively generated between pairs of electron beam through holes respectively formed on a first focusing electrode and a second focusing electrode which configure a focusing electrode system of an in-line electron gun, facing each other and corresponding to the electron beams of red, green and blue. A configuration of the in-line electron gun of the first conventional color picture tube is described referring to FIGS. 21(*a*) and 21(*b*).

As shown in FIG. 21(*a*), three in-line arranged square electron beam through holes 3, 4 and 5 are provided on an end face 1 of the first focusing electrode facing the second focusing electrode. Three pairs of protrusions 3*a* and 3*b*, 4*a* and 4*b*, and 5*a* and 5*b* are formed on right and left sides of respective electron beam through holes 3, 4 and 5 by bending a plate of the end face 1. Similarly, as shown in FIG. 21(*b*), three in-line arranged square electron beam through holes 6, 7 and 8 are provided on an end face 2 of the second focusing electrode facing the first focusing electrode. Three pairs of protrusions 6*a* and 6*b*, 7*a* and 7*b*, and 8*a* and 8*b* are formed on upper and lower sides of respective electron beam through holes 6, 7 and 8 by bending a plate of the end face 2. Furthermore, a predetermined focusing voltage Vf is applied to the first focusing electrode 1. A voltage, in which a dynamic voltage Vd is superimposed on the focusing voltage Vf, is applied to the second focusing electrode 2.

Thereby, the quadrupole fields are formed between the electron beam through holes 3 and 6, 4 and 7, and 5 and 8 corresponding to three electron beams. When the deflection angles of the electron beams are zero, the dynamic voltage Vd is 0 V. The dynamic voltage Vd gradually increases when the deflection angles of the electron beams become larger.

Hereupon, the shapes of the electron beam through holes 3 to 8 are made square in order to allow columnar mandrels to be inserted therein for positioning the focusing electrodes accurately assembly of the electron gun. However, the electron beam through holes 3 to 8 are formed square, so that the quadrupole fields can not be generated merely by the shapes of the electron beam through holes 3 to 8. Therefore, the protrusions 3*a* to 8*b* are indispensable.

In the first conventional in-line electron gun for the conventional color picture tube configured above, when the three electron beams pass through the uneven deflection magnetic field and the deflection angles of the electron beams are larger, the electron beams receive effects of deflection distortion. Negative distortions are previously applied to the electron beams by the quadrupole fields, so that the deflection distortions of the electron beams can be cancelled. As a result, a high resolution picture image can be displayed in the whole region on the screen of the color picture tube.

Generally, the distortions of the three electron beams, which are received in the uneven deflection magnetic field, become conspicuous when the size of the screen of the color picture tube is larger. Therefore, it is necessary to make the quadrupole fields more intensive in the color picture tube having a wide screen, in order to cancel the distortions of the beam spots due to the uneven deflection magnetic field. For generating the intensive quadrupole fields, the heights of the protrusions 3*a* to 8*b* in an axial direction of the tube must be higher. In such a case, it is difficult to maintain a width W between top ends of a pair of protrusions, for example, 3*a* and 3*b*, which are facing each other in a high accuracy. Furthermore, the protrusions are formed by bending of the plate at edges of the electron beam through holes, so that a height H of the protrusions 3*a*to 8*b* in the axial direction has a limitation. Therefore, it is proposed that the quadrupole fields be generated in a plurality of steps.

On the other hand, a second conventional in-line electron gun for a conventional color picture tube, for example, shown in Publication Gazette of Unexamined Japanese Patent Application Hei 3-93435, is described referring to FIGS. 22, 23(*a*), 23(*b*), 23(*c*) and 23(*d*). The second conventional in-line electron gun for the conventional color picture tube generates the quadrupole fields in two steps.

As shown in FIG. 22, the second conventional color picture tube comprises three in-line arranged cathodes 11*a*, 11*b* and 11*c*, a control grid electrode 12, an accelerating electrode 13, a first auxiliary electrode 14, a second auxiliary electrode 15, a first focusing electrode 16, a second focusing electrode 17 and a final accelerating electrode 18, which are disposed on an axis of the color picture tube. The first auxiliary electrode 14 is connected to the first focusing electrode 16. The second auxiliary electrode 15 is connected to the second focusing electrode 17.

As shown in FIG. 23(*a*), three electron beam through holes 15*a*, 15*b* and 15*c*, which have vertically oblong rectangular shapes, are provided on an end face of the second auxiliary electrode 15 facing the first focusing electrode 16. As shown in FIG. 23(*b*), three electron beam through holes 16*a*, 16*b* and 16*c*, which have horizontally oblong rectangular shapes, are provided on an end face of the first focusing electrode 16 facing the second auxiliary electrode 15. As shown in FIG. 23(*c*), three electron beam through holes 16*d*, 16*e* and 16*f*, which have vertically oblong rectangular shapes, are provided on an end face of the first focusing electrode 16 facing the second focusing electrode 17. As shown in FIG.23(*d*), three electron beam through holes 17*a*, 17*b* and 17*c*, which have horizontally oblong rectangular shapes, are provided on an end face of the second focusing electrode 17 facing the first focusing electrode 16.

A predetermined focusing voltage Vf is applied to the first auxiliary electrode 14 and the first focusing electrode 16. A voltage, in which a dynamic voltage Vd is superimposed on the focusing voltage Vf, is applied to the second auxiliary electrode 15 and the second focusing electrode 17. As mentioned above, when the deflection angles of the electron beams are zero, the dynamic voltage Vd is 0 V. The dynamic voltage Vd gradually increases when the deflection angles of the electron beams become larger.

In the above-mentioned second conventional color picture tube, when three electron beams pass through deflection magnetic fields and the deflection angle becomes larger, the electron beams receive deflection distortions. The deflection distortions of the electron beams, however, can be cancelled by quadrupole fields which are generated between the electron beam through holes on the first focusing electrode 16 and the second focusing electrode 17. Magnification of lens electric fields in a horizontal direction become different from those in a vertical direction by effects of the quadrupole fields generated between the first focusing electrode 16 and the second focusing electrode 17. Any discrepancy of the magnification of lens electric fields is cancelled by the quadrupole fields generated between the second auxiliary electrode 15 and the first focusing electrode 16. As a result, a high resolution picture image can be displayed in a whole region of the screen of the color picture tube.

When the screen of the color picture tube is much wider, it is necessary to make the quadrupole fields much more intensive for reducing the deflection distortions of the electron beams. Thus, electrodes to which the focusing voltage is applied and other electrodes to which the dynamic voltage is applied are to be disposed much closer. However, when the electrodes are disposed closer, electrostatic capacitance between the electrodes increases. Therefore, voltage fluctuation occurs due to interference between the dynamic voltage and the focusing voltage. As a result, it is difficult to generate the quadrupole fields stably.

SUMMARY OF THE INVENTION

An objective of this invention is to generate intensive quadrupole fields which can cancel the deflection distortions of the electron beams without reducing the accuracy of the focusing system. Another objective of this invention is to prevent the fluctuation of the quadrupole fields due to the interference between the focusing voltage and the dynamic voltage by reducing the electrostatic capacitance between the electrodes to which the dynamic voltage is applied and the electrodes to which the focusing voltage is applied. Still other objectives of this invention are to provide a large and flat screen color picture tube in which a high resolution picture image can be displayed over the whole region of the screen, and to provide an in-line electron gun which is suitable for the large screen color picture tube and generates intensive quadrupole electric fields for cancelling the deflection distortion of the electron beams at the periphery of the screen.

A first embodiment of a color picture tube of this invention comprises a funnel, a panel, a phosphor screen disposed inside of the panel, a shadow mask disposed in the vicinity of the phosphor screen and an in-line electron gun disposed in a neck part of the funnel. The electron gun has three cathodes which are arranged in a horizontal direction, a control electrode, an accelerating electrode, a first focusing electrode, a second focusing electrode and a final accelerating electrode. Three electron beam through holes are arranged on an end face of the first focusing electrode facing the second focusing electrode, and are formed to have a vertically oblong rectangular shape. Three electron through holes are arranged on an end face of the second focusing electrode facing said first focusing electrode, and are formed to have a horizontally oblong rectangular shape. A pair of protrusions is provided in the vicinity of both oblong sides of each electron beam through hole on at least one of the end faces of the first focusing electrode and the second focusing electrode, protruding in the direction of the other focusing electrode. A predetermined focusing voltage is applied to the first focusing electrode and a voltage, in which a dynamic voltage gradually increases corresponding to an increase of the deflection angle of the electron beams is superimposed on the focusing voltage, is applied to the second focusing electrode.

By the above-mentioned configuration, intensive quadrupole fields can be generated between the first focusing electrode and the second focusing electrode by an interaction of the oblong rectangular shapes of the electron beam through holes and the protrusions. Therefore, the heights of the protrusions in an axial direction of the color picture tube, by which a desired intensity of the quadrupole fields can be obtained, can be shortened. The distance between the pair of protrusions at open ends of them can be maintained at a high accuracy. Furthermore, it is not necessary to dispose the first focusing electrode near to the second focusing electrode, or to generate the quadrupole fields at plural stages. Therefore, an electrostatic capacitance between the first focusing electrode and the second focusing electrode can be made small. Furthermore, a fluctuation of the dynamic voltage can be prevented.

Alternatively, a second embodiment of a color picture tube of this invention comprises a funnel, a panel, a phosphor screen disposed inside of the panel, a shadow mask disposed in the vicinity of the phosphor screen and an in-line electron gun disposed in a neck part of the funnel. The electron gun has three cathodes which are arranged in a horizontal direction, a control electrode, an accelerating electrode, a first focusing electrode, a second focusing electrode and a final accelerating electrode. Three electron beam through holes are arranged on an end face of the first focusing electrode facing the second focusing electrode, and are formed to have a vertically oblong rectangular shape. Three electron through holes are arranged on an end face of the second focusing electrode facing said first focusing electrode, and are formed to have a horizontally oblong rectangular shape. A rectangular tube is provided in the vicinity of each electron beam through hole on at least one of the end faces of the first focusing electrode and the second focusing electrode, protruding toward the other focusing electrode and enclosing respective sides of each electron beam through hole. A predetermined focusing voltage is applied to the first focusing electrode. A voltage, in which a dynamic voltage which gradually increases corresponding to an increase of the deflection angle of the electron beams is superimposed on the focusing voltage, is applied to the second focusing electrode.

By the above-mentioned configurations, intensive quadrupole fields can be generated between the first focusing electrode and the second focusing electrode while maintaining the distance between the first focusing electrode and the second focusing electrode at a predetermined value. Therefore, a fluctuation of the dynamic voltage due to an increase of an electrostatic capacitance between the first focusing electrode and the second focusing electrode can be prevented.

In the above-mentioned configurations, it is preferable that shape of the electron beam through holes on at least an end face of the first focusing electrode and the second focusing electrode is a deformed octagon in which the four corners are cut along the longer sides of each electron beam through hole. By such a configuration, the electric field is intensified at the four corners by cutting the corners of each electron beam through hole. Therefore, a quadrupole field which is more intensive than the quadrupole field by rectangular electron beam through hole can be generated.

Furthermore, a third embodiment of a color picture tube of this invention comprises a funnel, a panel, a phosphor screen disposed inside of the panel, a shadow mask disposed in the vicinity of the phosphor screen and an in-line electron gun disposed in a neck part of the funnel. The electron gun has three cathodes which are arranged in a horizontal direction, a control electrode, an accelerating electrode, a first auxiliary electrode, a second auxiliary electrode, a first focusing electrode, a second focusing electrode and a final accelerating electrode. At least one group of three electron beam through holes are arranged on the end faces of the first focusing electrode and the second focusing electrode opposing each other, and are formed to have a non-circular shape for generating quadrupole fields between the first focusing electrode and the second focusing electrode. Three electron through holes are arranged on an end face of the second auxiliary electrode facing the first focusing electrode, and are formed to have a vertically oblong non-circular shape. Three electron through holes are arranged on an end face of the first focusing electrode facing the second auxiliary electrode, and are formed to have a horizontally oblong non-circular shape. A pair of protrusions is provided in the vicinity of both longer sides of each electron beam through hole on at least an end face of the first focusing electrode facing the second auxiliary electrode and the second auxiliary electrode facing the first focusing electrode, and are protruded toward the other electrode. The first auxiliary electrode and the first focusing electrode are connected, and a predetermined focusing voltage is applied to them. The second auxiliary electrode and the second focusing electrode are connected and a voltage, in which a dynamic voltage which gradually increases corresponding to an increase of the deflection angle of the electron beams is superimposed on the focusing voltage, is applied to them.

By the above-mentioned configuration, intensive quadrupole fields can be generated, while the electrostatic capacitance between an electrode to which the focusing voltage is applied and another electrode to which the dynamic voltage is applied can relatively be reduced. Furthermore, the focusing voltage and the dynamic voltage will not interfere each other, so that the fluctuation of the quadrupole fields can be prevented.

In the above-mentioned configuration, it is preferable that the three electron beam through holes on an end face of the first focusing electrode facing the second focusing electrode are formed to have a vertically oblong non-circular shape. The three electron beam through holes on an end face of the second focusing electrode facing the first focusing electrode are formed to have a horizontally oblong non-circular shape, and a pair of protrusions is provided in the vicinity of longer sides of each electron beam through hole on at least one of the end faces of the first focusing electrode and the second focusing electrodes, protruding toward the other focusing electrode.

In the above-mentioned configurations, it is preferable that shapes of the non-circular electron beam through holes are substantially rectangular or a deformed octagon in which the four corners are cut along the oblong sides.

BRIEF DESCRIPTION OF THE DRAWINGS

FIG. 3(*b*) is a perspective view showing a configuration of an end face of the second focusing electrode facing the first focusing electrode in the first embodiment;

FIG. 6(*b*) is a perspective view showing another configuration of an end face of the second focusing electrode facing the first focusing electrode in the first embodiment;

FIG. 7(*b*) is a perspective view showing still another configuration of an end face of the second focusing electrode facing the first focusing electrode in the first embodiment;

FIG. 8(*b*) is a perspective view showing still another configuration of an end face of the second focusing electrode facing the first focusing electrode in the first embodiment;

FIG. 9(*b*) is a perspective view showing still another configuration of an end face of the second focusing electrode facing the first focusing electrode in the first embodiment;

FIG. 10(*b*) is a perspective view showing still another configuration of an end face of the second focusing electrode facing the first focusing electrode in the first embodiment;

FIG. 11(*b*) is a perspective view showing still another configuration of an end face of the second focusing electrode facing the first focusing electrode in the first embodiment;

FIG. 12(*b*) is a perspective view showing still another configuration of an end face of the second focusing electrode facing the first focusing electrode in the first embodiment;

FIG. 13(*b*) is a perspective view showing still another configuration of an end face of the second focusing electrode facing the first focusing electrode in the first embodiment;

FIG. 15(*b*) is a perspective view showing a configuration of an end face of the first focusing electrode facing the second auxiliary electrode in the second embodiment;

FIG. 15(*c*) is a perspective view showing a configuration of an end face of the first focusing electrode facing a second focusing electrode in the second embodiment;

FIG. 15(*d*) is a perspective view showing a configuration of an end face of the second focusing electrode facing the first focusing electrode in the second embodiment;

FIG. 17(*b*) is a perspective view showing another configuration of an end face of the first focusing electrode facing the second auxiliary electrode in the second embodiment;

FIG. 21(*b*) is the perspective view showing the end face of the second focusing electrode facing the first focusing electrode in the first conventional in-line electron gun;

FIG. 23(*b*) is the plan view showing the configuration of the end face of the first focusing electrode facing the second auxiliary electrode in the second conventional in-line electron gun;

FIG. 23(*c*) is the plan view showing the configuration of the end face of the first focusing electrode facing the second focusing electrode in the second conventional in-line electron gun; and FIG. 23(*d*) is the plan view showing the configuration of the end face of the second focusing electrode facing the first focusing electrode in the second conventional in-line electron gun.

DETAILED DESCRIPTION OF THE INVENTION

Figure 1:
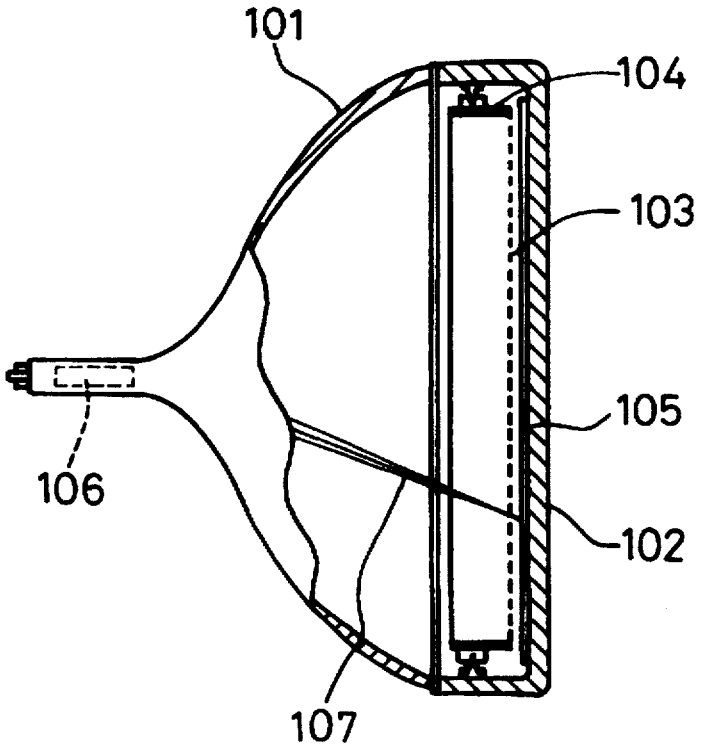
FIG. 1 is a partially cross-sectional plan view showing a configuration of a color picture tube of this invention.

A first embodiment of a color picture tube and an in-line electron gun for the color picture tube of this invention is described referring to the drawings. FIG. 1 is a partially cross-sectional plan view showing a configuration of the color picture tube of this invention. In FIG. 1, the color picture tube comprises a funnel 101 made of glass, a panel 102 made of glass, a phosphor screen 105 disposed inside the panel 102, a shadow mask 103 disposed substantially parallel to the phosphor screen 105, a frame 104 for holding the shadow mask 103, and an in-line electron gun 106 disposed in a neck part of the funnel 101.

Electron beams 107, which are irradiated from the in-line electron gun 106 and corresponding to colors of red, green and blue, pass through electron beam through holes disposed on predetermined positions on the shadow mask 103, and reach phosphor regions corresponding to red, blue and green on the phosphor screen 105. The phosphor regions, which are irradiated by the electron beams 107, respectively radiate red, blue and green lights. Thereby, a color picture image is displayed on a screen of the panel 102. The screen of the panel 102 is wide and perfectly flat, and the aspect ratio of the screen is more than 9:16.

Figure 2:
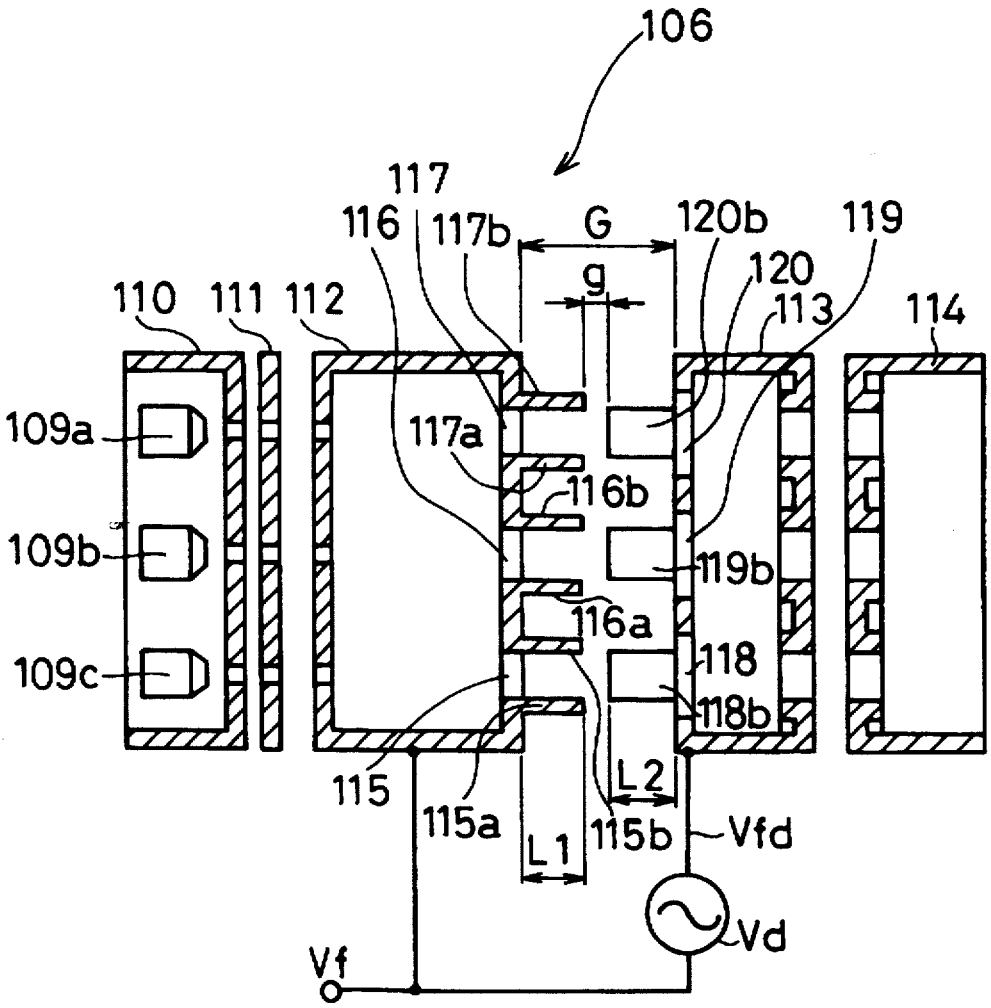
FIG. 2 is a cross-sectional plan view showing a configuration of a first embodiment of an in-line electron gun in the color picture tube of this invention.

The in-line electron gun shown in FIG. 2 comprises three in-line arranged cathodes 109*a*, 109*b* and 109*c*, a control grid electrode 110, an accelerating electrode 111, a first focusing electrode 112, a second focusing electrode 113 and a final accelerating electrode (anode) 114 in an axial direction of the funnel 101. A predetermined focusing voltage Vf is applied to the first focusing electrode 112. A voltage Vfd, in which the dynamic voltage Vd is superimposed on the focusing voltage Vf, is applied to the second focusing electrode 113. The dynamic voltage Vd is initially 0 V when the deflection angles of the electron beams are 0 degree, and it gradually increases to about 700 V as the deflection angles of the electron beams become larger.

Figure 3A:
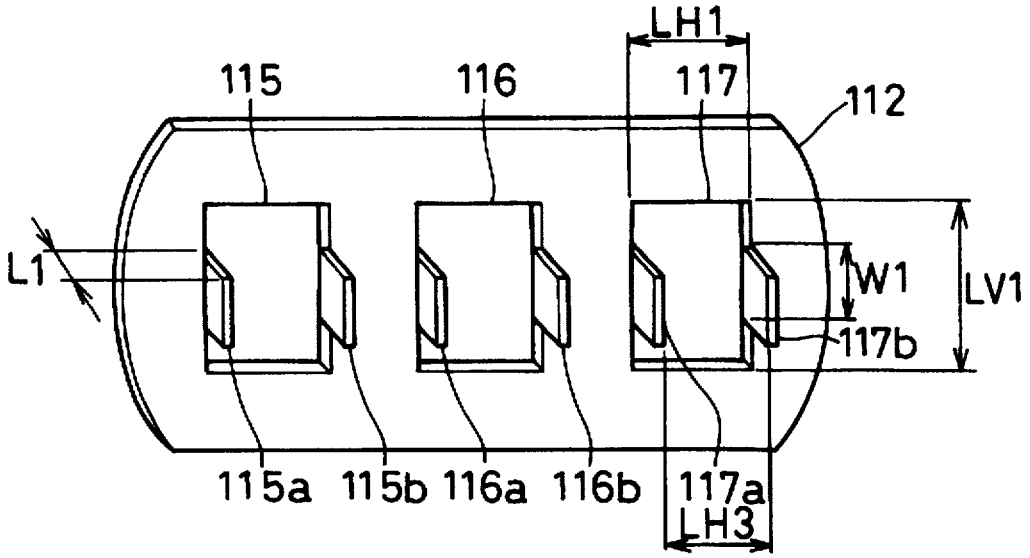
FIG. 3(*a*) is a perspective view showing a configuration of an end face of a first focusing electrode facing a second focusing electrode in the first embodiment.
Figure 3B:
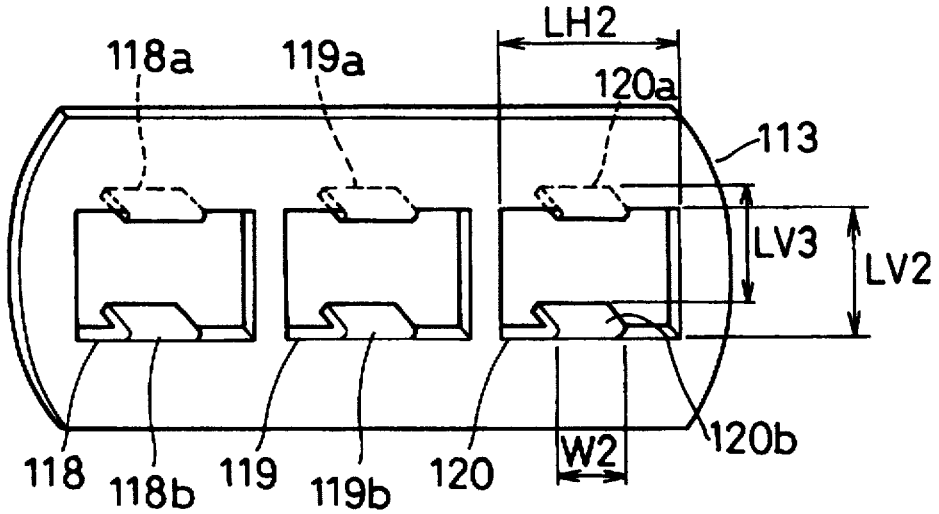

As shown in FIG. 3(*a*), three in-line arranged electron beam through holes 115, 116 and 117, which have vertically oblong rectangular shapes, are provided on an end face of the first focusing electrode 112 facing the second focusing electrode 113. Three sets of protrusions 115*a* and 115*b*, 116*a* and 116*b*, and 117*a* and 117*b* are provided on the respective longer sides of the electron beam through holes 115, 116 and 117, which are formed by bending the plate of the end face of the first focusing electrode 112, protruding toward the second focusing electrode 113 in the axial direction of the funnel 101.

As shown in FIG. 3(*b*), three in-line arranged electron beam through holes 118, 119 and 120, which have horizontally oblong rectangular shapes, are provided on an end face of the second focusing electrode 113 facing the first focusing electrode 112. Three sets of protrusions 118*a* and 118*b*, 119*a* and 119*b*, and 120*a* and 120*b* are provided on the respective longer sides of the electron beam through holes 118, 119 and 120, which are formed by bending the plate of the end face of the second focusing electrode 113, protruding toward the first focusing electrode 112 in the axial direction of the funnel 101.

Figure 4:
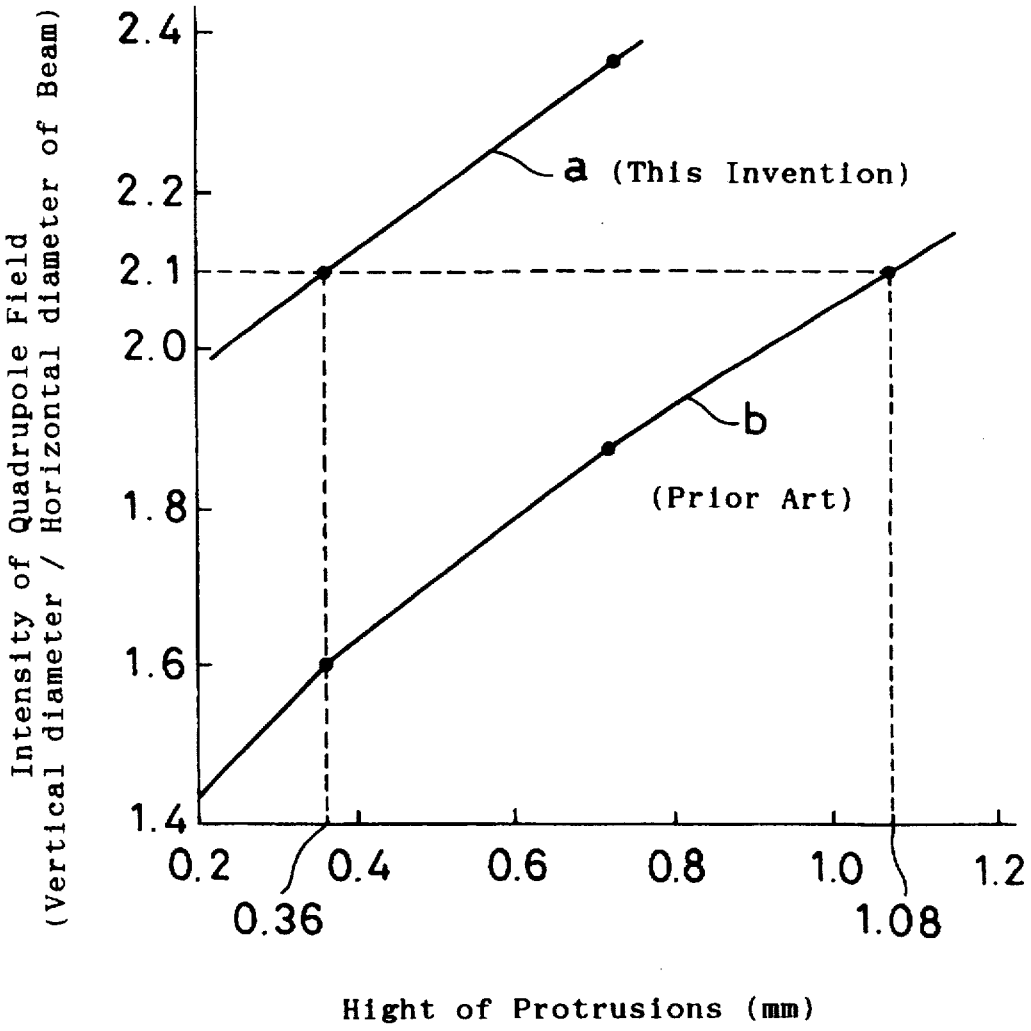
FIG. 4 is a graph showing a relation of a height of protrusions to intensity of quadrupole fields in the first embodiment.

A relation of a height of each protrusion to an intensity of the quadrupole field generated between the end faces of the first and second focusing electrodes 112 and 113 is shown in FIG. 4. Hereupon, the intensity of the quadrupole field is defined by a diameter of the electron beam in the vertical direction against a diameter of the electron beam in the horizontal direction. An analysis was executed by calculation. Conditions in the analysis by calculation are disclosed below.

Common Data:

Focusing voltage Vf=7.56 kV

Dynamic voltage Vd=700 V

Data of the first embodiment shown by characteristic curve "a":

Sizes of the electron beam through holes;

LH1=1.68 mm

LV1=3.40 mm

LH2=3.40 mm

LV2=1.68 mm

Protrusions;

LH3=1.2 mm

LV3=1.2 mm g=0.48 mm

W1=0.77 mm

W2=0.77 mm

Data of the first conventional in-line electron gun shown by characteristic curve "b":

Sizes of the electron beam through holes;

LH1=1.68 mm

LV1=1.68 mm

LH2=1.68 mm

LV2=1.68 mm

Protrusions;

LH3=1.2 mm

LV3=1.2 mm g=0.48 mm

W1=1.2 mm

W2=1.2 mm

As can be seen from FIG. 4, the height of the protrusions, by which a predetermined intensity (for example, 2.1) for the quadrupole field can be obtained, was 1.08 mm by the first conventional in-line electron gun shown by the characteristic curve "b". On the other hand, the height of the protrusions by the first embodiment of this invention shown by the characteristic curve "a" was only 0.36 mm for obtaining this predetermined intensity.

The length of each shorter side of the electron beam through hole was 1.68 mm, so that the largest value of the height of each protrusion was 0.84 mm (i.e. 1.68 mm/2) when the protrusion was formed by bending the plate of the end face of the electrode. Thus, it is obvious that the protrusion having the height of 0.36 mm based on this invention can be formed by bending the plate of the end face of the electrode. However, it is impossible to form the protrusion having the height of 1.08 mm based on the first conventional in-line electron gun by bending the plate of end face of the electrode.

With respect to the accuracy of a distance between top ends of a pair of the protrusions, when a tolerance of an angle between the end face of the electrode and the protrusion was +2 degrees against the right angle of 90 degrees, the distance between the open ends of the protrusions based on this invention was 1.2 mm+0.025 mm. On the other hand, the distance between the open ends of the protrusions based on the prior art was 1.2 mm+0.075 mm. Thus, the distance between the top ends of the protrusions based on this invention was clearly accurate.

Figure 5:
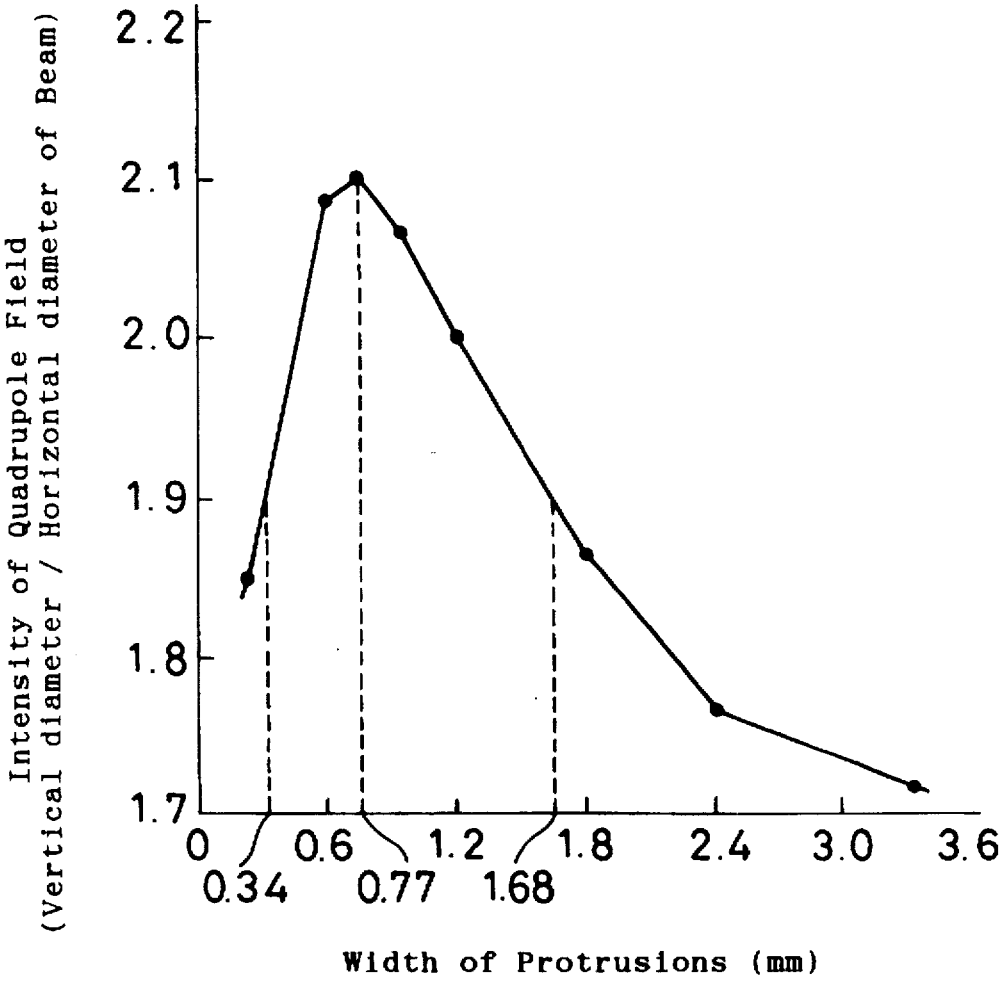
FIG. 5 is a graph showing a relation of a width of the protrusions to the intensity of the quadrupole fields in the first embodiment.

In the above-mentioned first embodiment, the reason why a width of each protrusion was decided to 0.77 mm is described. A relation of a width of each protrusion to an intensity of the quadrupole field is shown in FIG. 5. As can be seen from FIG. 5, when the width of the protrusion was set in a range from 0.34 to 1.68 mm, and especially set at 0.77 mm, the intensity of the quadrupole field becomes the largest. The range of 0.34 to 1.68 mm corresponds to 0.2 to 1.0 times as long as the length 1.68 mm of the side of a perspective square formed by spatially superimposing the electron beam through holes of the first and second focusing electrodes 112 and 113.

Other configurations of three sets of the protrusions 115*a* to 117*b* provided on the first focusing electrode 112 and three sets of the protrusions 118*a* to 120*b* provided on the second focusing electrodes 113 are described below.

Figure 6:
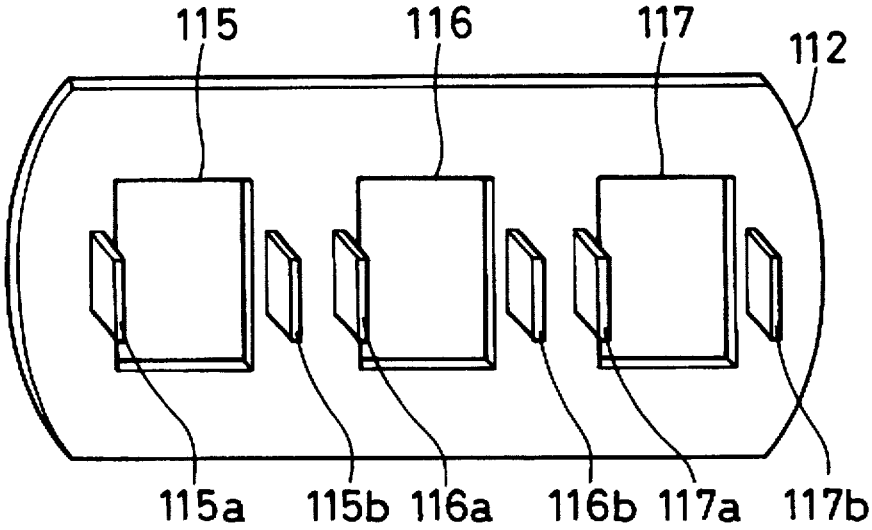
FIG. 6(*a*) is a perspective view showing another configuration of an end face of a first focusing electrode facing a second focusing electrode in the first embodiment.
Figure 6:
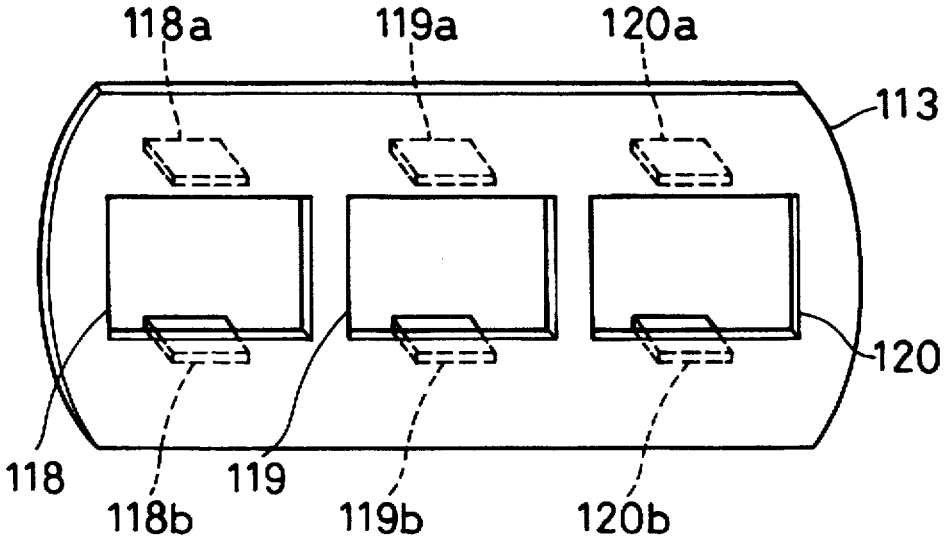
Figure 7:
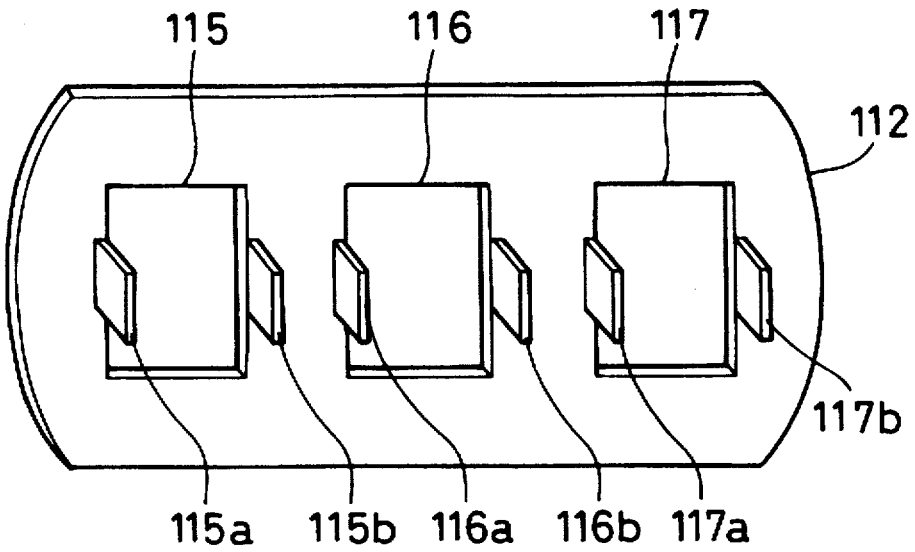
FIG. 7(*a*) is a perspective view showing still another configuration of an end face of a first focusing electrode facing a second focusing electrode in the first embodiment.
Figure 7:
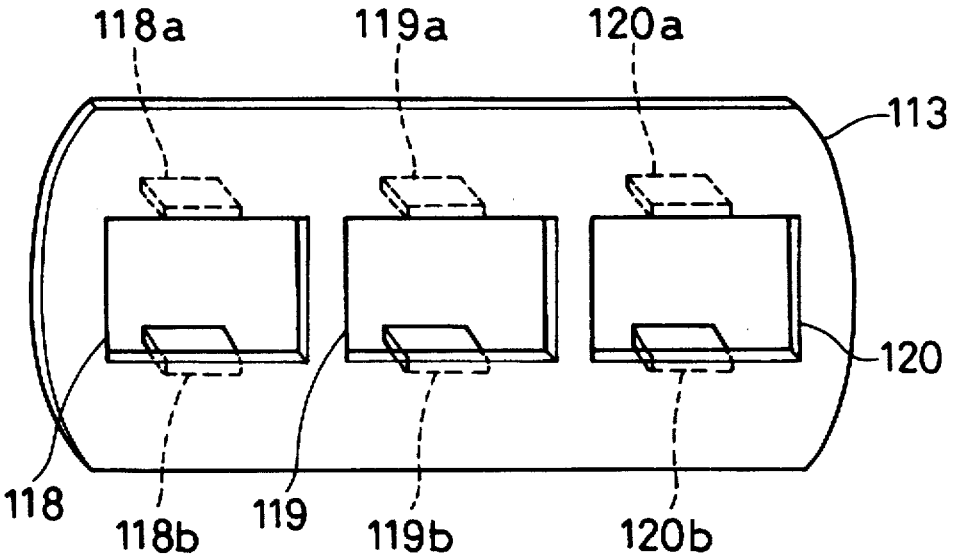

FIGS. 6(*a*) and 6(*b*) show an example in which the protrusions 115*a* to 117*b* which are to be provided on the first focusing electrode 112 and the protrusions 118*a* to 120*b* which are to be provided on the second focusing electrode 113 are formed by welding of plate members in the vicinity of the longer sides of the electron beam through holes 115 to 120. The protrusions 115*a* to 120*b* are disposed slightly off of the edges of the longer sides of the electron beam through holes 115 to 120. FIGS. 7(*a*) and 7(*b*) show another example in which the protrusions 115*a* to 117*b* which are to be provided on the first focusing electrode 112 and the protrusions 118*a* to 120*b* which are to be provided on the second focusing electrode 113 are formed by welding of plate members in the vicinity of the longer sides of the electron beam through holes 115 to 120. The protrusions 115*a* to 120*b* are disposed essentially at the edges of the longer sides of the electron beam through holes 115 to 120. In comparison with the example shown in FIGS. 6(*a*) and 6(*b*) and the example shown in FIGS. 7(*a*) and 7(*b*), the latter example can generate a more intensive quadrupole field, since the protrusions are closer to the edges of the longer sides of the electron beam through holes. On the other hand, the former example is easily manufactured, since the plate members are welded at positions spaced from the edges of the longer sides of the electron beam through holes.

Figure 8:
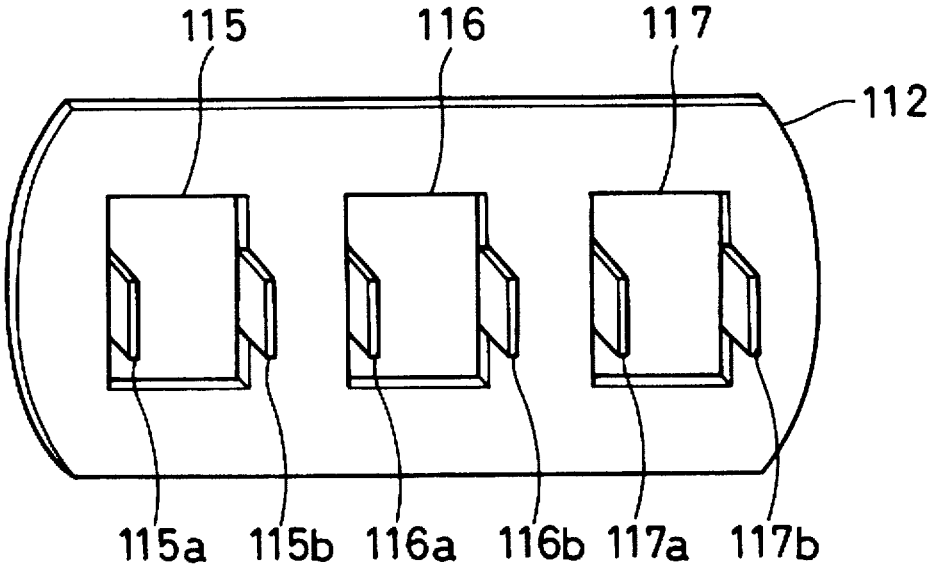
FIG. 8(*a*) is a perspective view showing still another configuration of an end face of a first focusing electrode facing a second focusing electrode in the first embodiment.
Figure 8:
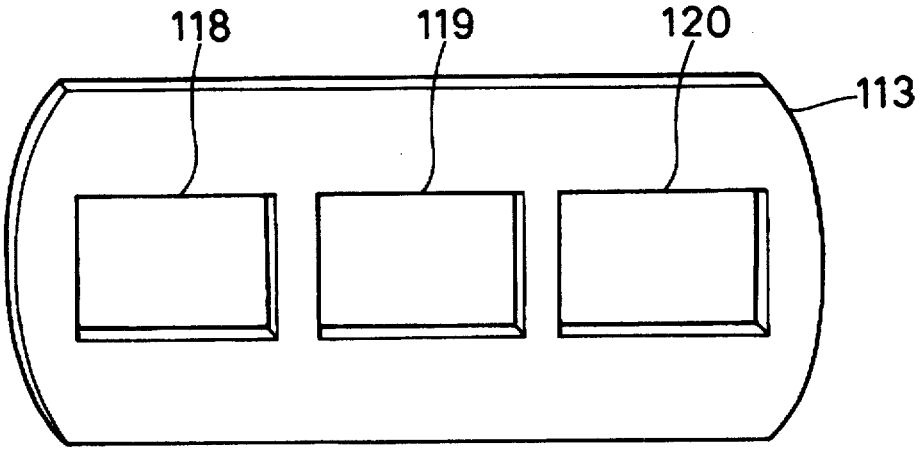
Figure 9:
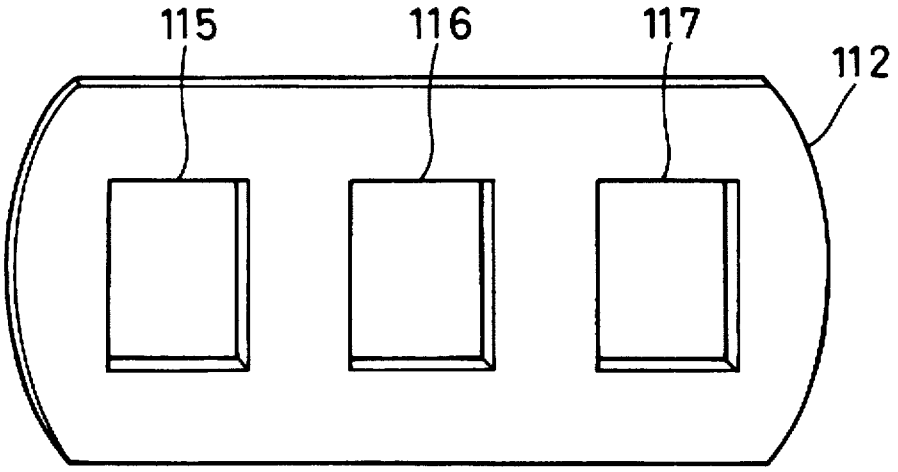
FIG. 9(*a*) is a perspective view showing still another configuration of an end face of a first focusing electrode facing a second focusing electrode in the first embodiment.
Figure 9:
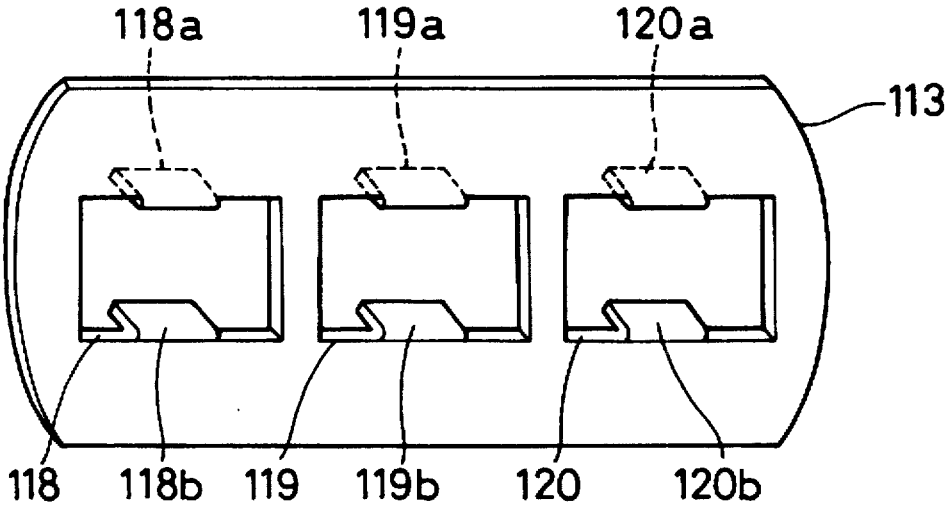

FIGS. 8(*a*) and 8(*b*) show still another example in which the protrusions 115*a* to 117*b* are provided only on the first focusing electrode 112. Alternatively, FIGS. 9(*a*) and 9(*b*) show still another example in which the protrusions 118*a* to 120*b* are provided only on the second focusing electrode 113.

Figure 10:
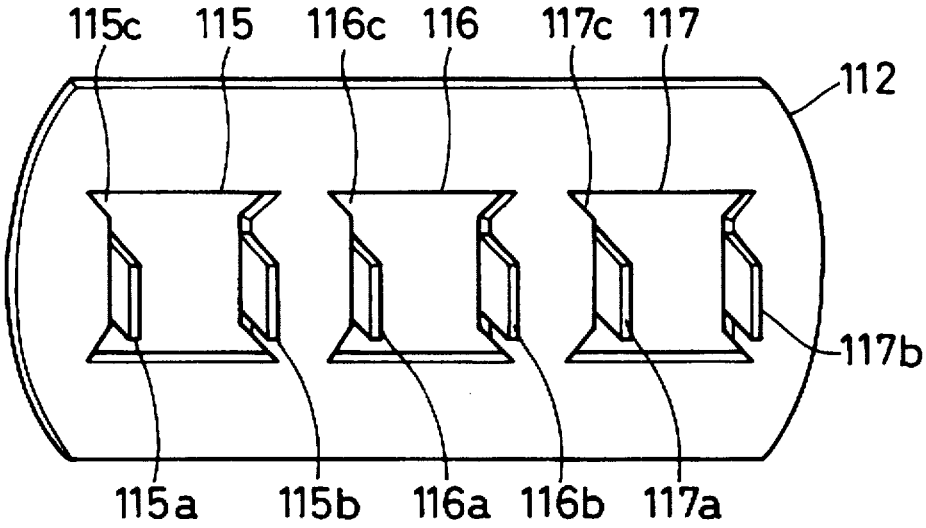
FIG. 10(*a*) is a perspective view showing still another configuration of an end face of a first focusing electrode facing a second focusing electrode in the first embodiment.
Figure 10:
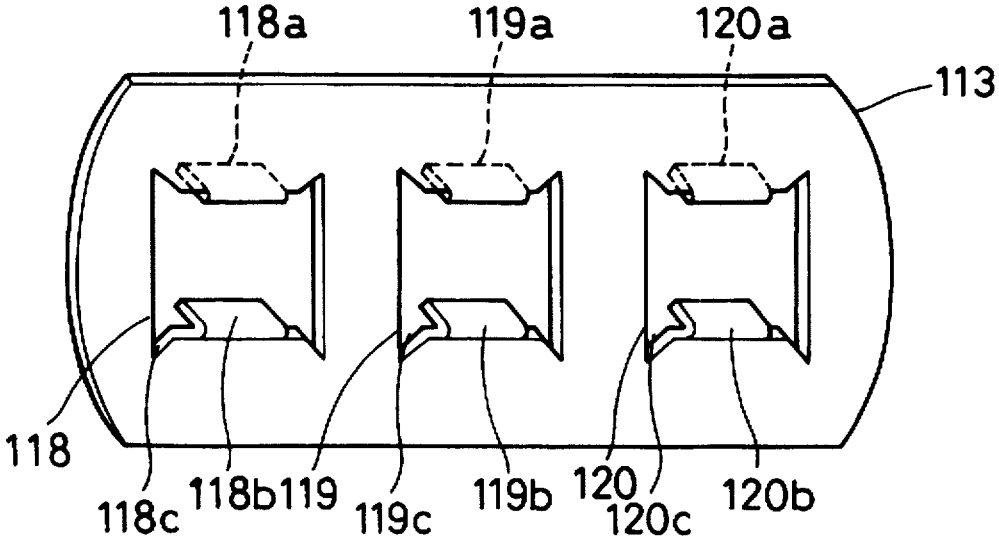

FIGS. 10(*a*) and 10(*b*) show still another example in which the shape of the electron beam through holes 115 to 120 is not rectangular, but a deformed octagon in which four corners 115*c* to 120*c* of respective electron beam through holes 115 to 120 are cut along the longer sides. By cutting the four corners of the electron beam through holes, the electric field can be intensified at the corners, so that the quadrupole field generated by the deformed octagonal electron beam through hole is more intensive than that generated by the rectangular electron beam through hole. Alternatively, the rectangular electron beam through holes can be used with a combination of the deformed octagonal electron beam through holes, even when the quadrupole field can be generated by the shapes of the electron beam through holes.

Figure 11A:
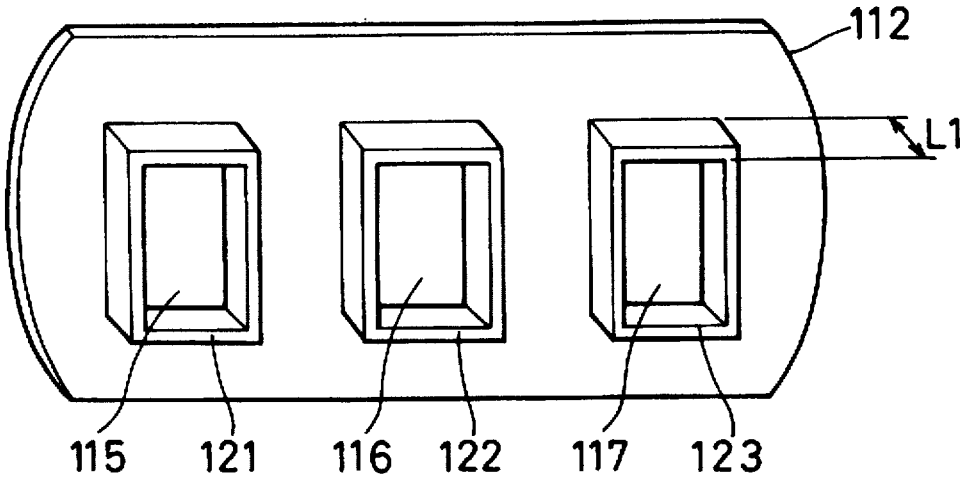
FIG. 11(*a*) is a perspective view showing still another configuration of an end face of a first focusing electrode facing a second focusing electrode in the first embodiment.
Figure 11B:
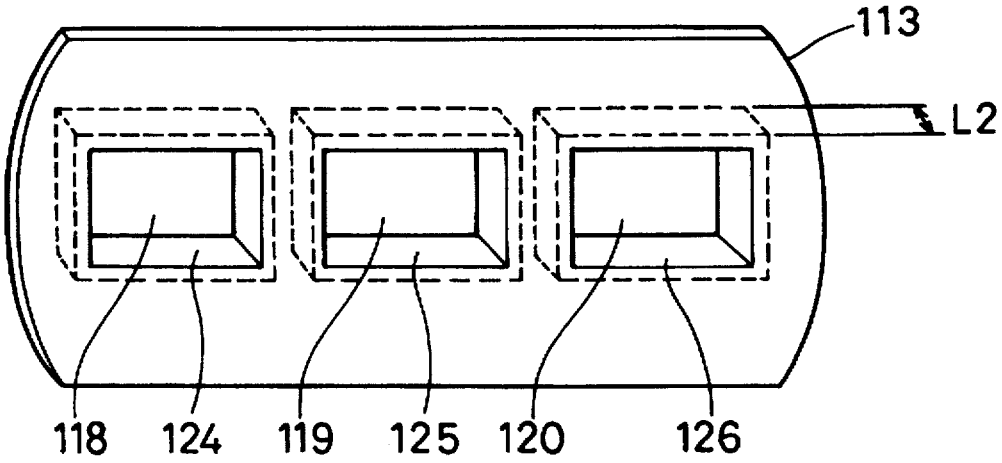

In general, when a gap G between the end faces of the first and second focusing electrodes 112 and 113 becomes wider, an electrostatic capacitance between both focusing electrodes becomes smaller. Thus, fluctuation of the quadrupole field due to the interference of the dynamic voltage and the focusing voltage can be made smaller. FIGS. 11(*a*) and 11(*b*), show still another example in which three electron beam through holes 115 to 117, which have a vertically oblong rectangular shape, are provided on an end face of the first focusing electrode 112 facing the second focusing electrode 113. Furthermore, three rectangular tubes 121 to 123, which are protruded toward the second focusing electrode 113 and enclose respective electron beam through holes 115 to 117, are also provided on the end face of the first focusing electrode 112 facing the second focusing electrode 113. Similarly, three electron beam through holes 118 to 120, which have a horizontally oblong rectangular shape, are provided on an end face of the second focusing electrode 113 facing the first focusing electrode 112. Furthermore, three rectangular tubes 124 to 126, which are protruded toward the first focusing electrode 112 and enclose respective electron beam through holes 118 to 120, are also provided on the end face of the second focusing electrode 113 facing the first focusing electrode 112.

When the gaps ("g" in FIG. 2) between top ends of the rectangular tubes 121 to 123 and top ends of the rectangular tubes 124 to 126 become narrower, the intensities of the quadrupole fields become larger. On the other hand, when the gap "G" between the end faces of the focusing electrodes 112 and 113 which are facing each other becomes wider, the electrostatic capacitance between the end faces becomes smaller. Hereupon, when heights L1 of the rectangular tubes 121 to 123 are 0.5 mm, heights L2 of the rectangular tubes 124 to 126 are 0.5 mm, and the gaps "g" between the top ends of the rectangular tubes 121 to 124 and the top ends of the rectangular tubes 124 to 126 are 1.0 mm, the gap "G" between the end faces of the first and second focusing electrodes 112 and 113 is G=g+L1+L2=2.0 mm. The electrostatic capacitance due to the rectangular tubes 121 to 126 can be ignored, so that the electrostatic capacitance between the first and second focusing electrodes 112 and 113 can be made much smaller than that of the focusing electrodes in the first conventional in-line electron gun having no rectangular tube at all (wherein the gap G=1.0 mm), without reducing the intensities of the quadrupole fields.

Figure 12:
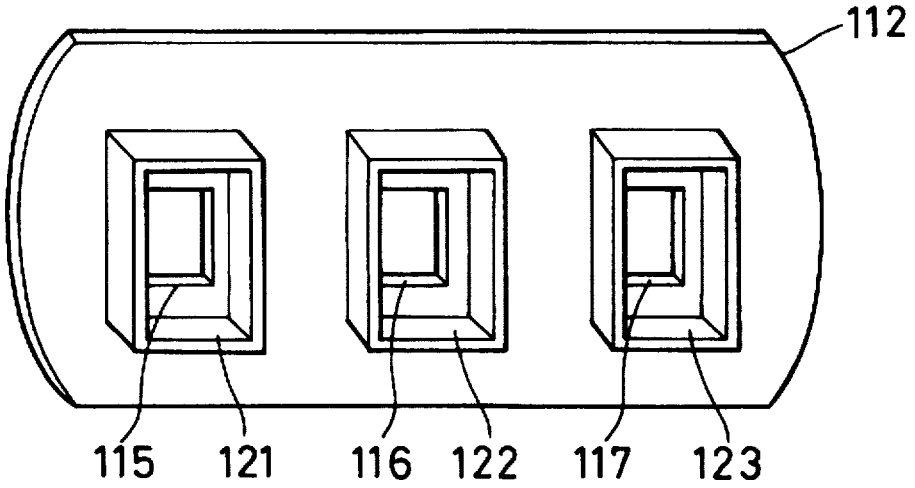
FIG. 12(*a*) is a perspective view showing still another configuration of an end face of a first focusing electrode facing a second focusing electrode in the first embodiment.
Figure 12:
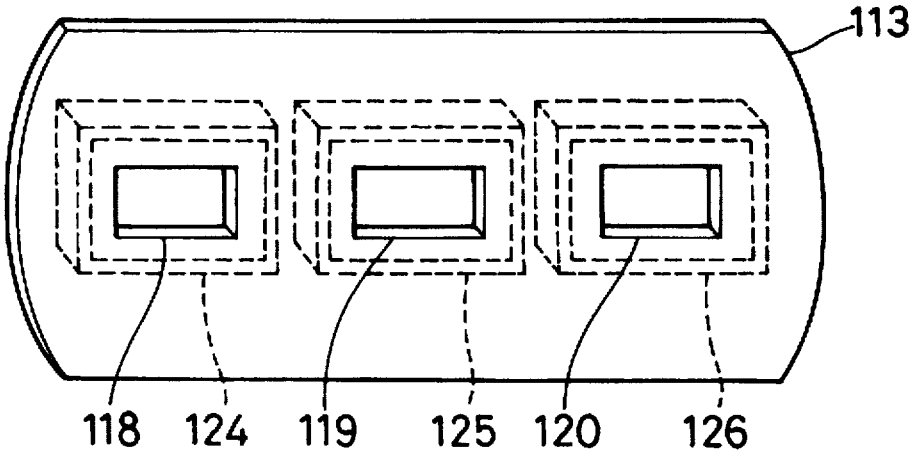

FIGS. 12(*a*) and 12(*b*) show still another example in which the rectangular tubes 121 to 126 are provided at positions spaced slightly from the edges of the rectangular electron beam through holes 115 to 120.

Figure 13:
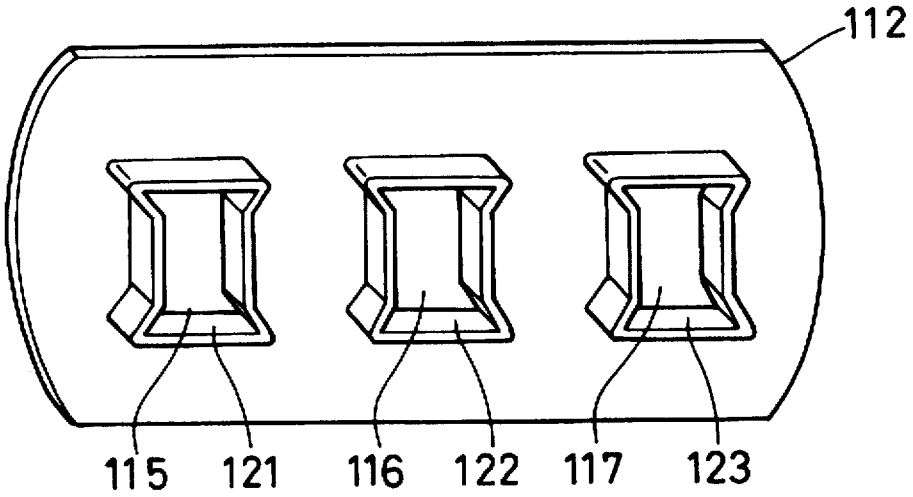
FIG. 13(*a*) is a perspective view showing still another configuration of an end face of a first focusing electrode facing a second focusing electrode in the first embodiment.
Figure 13:
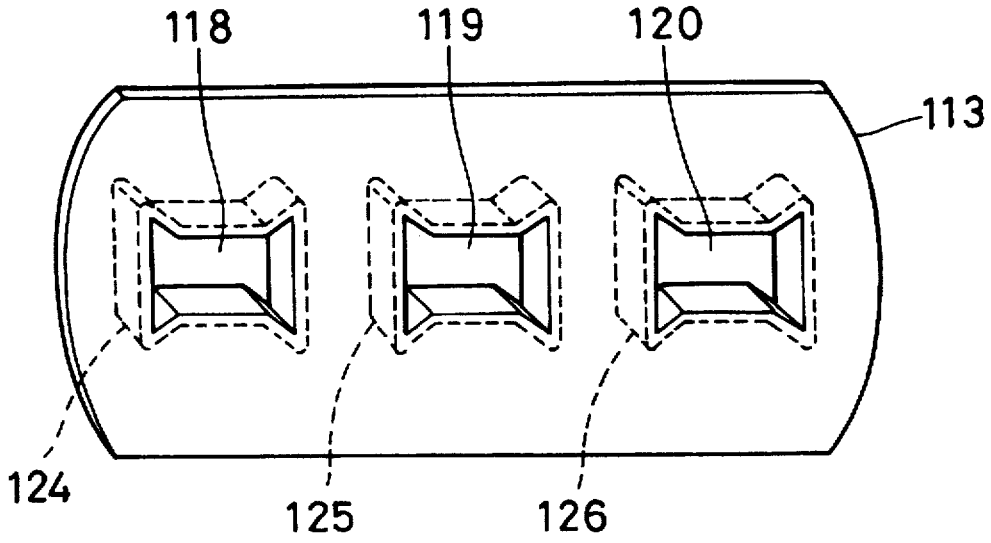

FIGS. 13(*a*) and 13(*b*) show still another example in which the shapes of the electron beam through holes 115 to 120 are a deformed octagon in which four corners are cut along the longer sides, and deformed octagonal tubes 121 to 126 are formed for enclosing the electron beam through holes 115 to 120.

In the above-mentioned examples, rectangular or deformed octagonal tubes are provided at edge parts of electron beam through holes on the first and second focusing electrodes 112 and 113. However, it is possible to provide the tubes on only one of the focusing electrodes. Effects of the tubes for reducing the electrostatic capacitance between the focusing electrodes 112 and 113 are not affected by the shapes of the electron beam through holes, so that the shapes of the electron beam through holes are not necessarily a rectangular shape. Even when the rectangular shaped electron beam through holes and the deformed octagonal shaped electron beam through holes are combined, the same effects such as intensive quadrupole fields and small electrostatic capacitance between the focusing electrode can be obtained.

Figure 14:
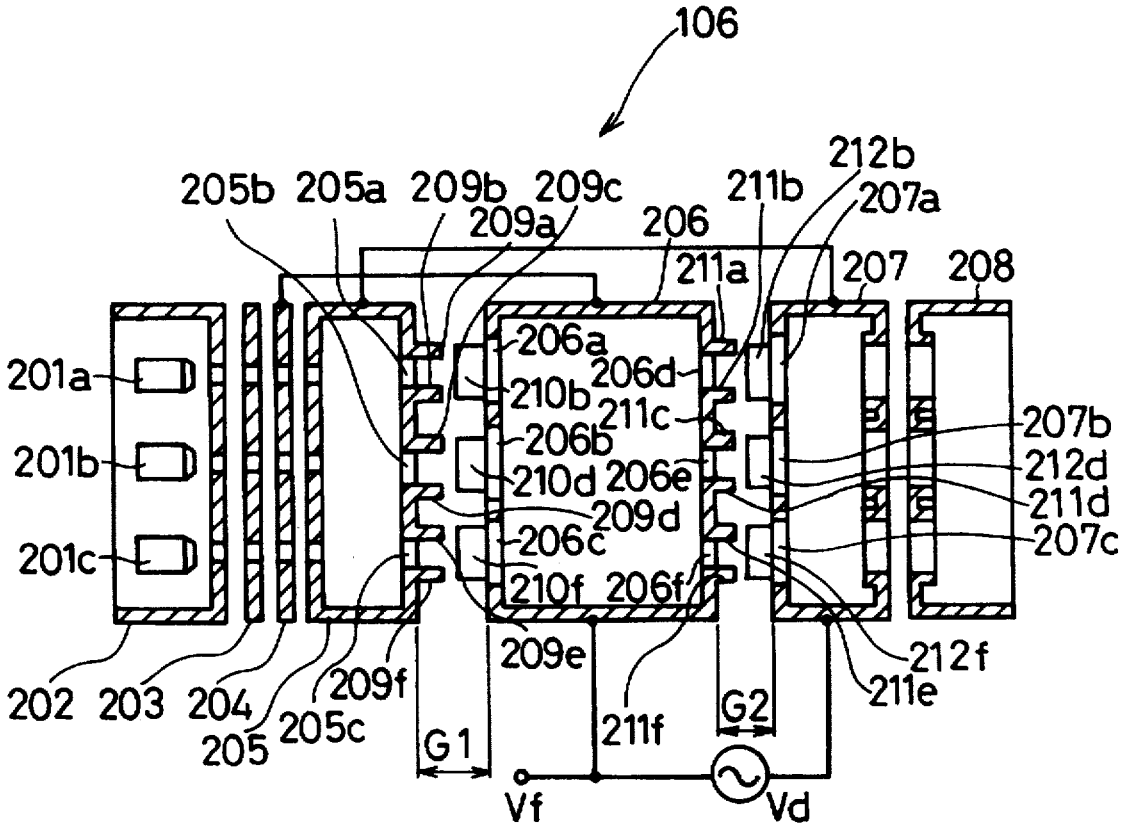
FIG. 14 is a cross-sectional plan view showing a configuration of a second embodiment of an in-line electron gun in the color picture tube of this invention.

A second embodiment of a color picture tube of this invention and an in-line electron gun suitable for the color picture tube is described referring to the drawings. FIG. 14 is a cross-sectional plan view showing a configuration of the in-line electron gun of the color picture tube in the second embodiment. The in-line electron gun shown in FIG. 14 comprises three in-line arranged cathodes 201*a*, 201*b* and 201*c*, a control grid electrode 202, an accelerating electrode 203, a first auxiliary electrode 204, a second auxiliary electrode 205, a first focusing electrode 206, a second focusing electrode 207 and a final accelerating electrode 208, which are serially arranged in the axial direction of the funnel 101. The first auxiliary electrode 204 and the first focusing electrode 206 are electrically connected. The second auxiliary electrode 205 and the second focusing electrode 207 are also electrically connected.

Figure 22:
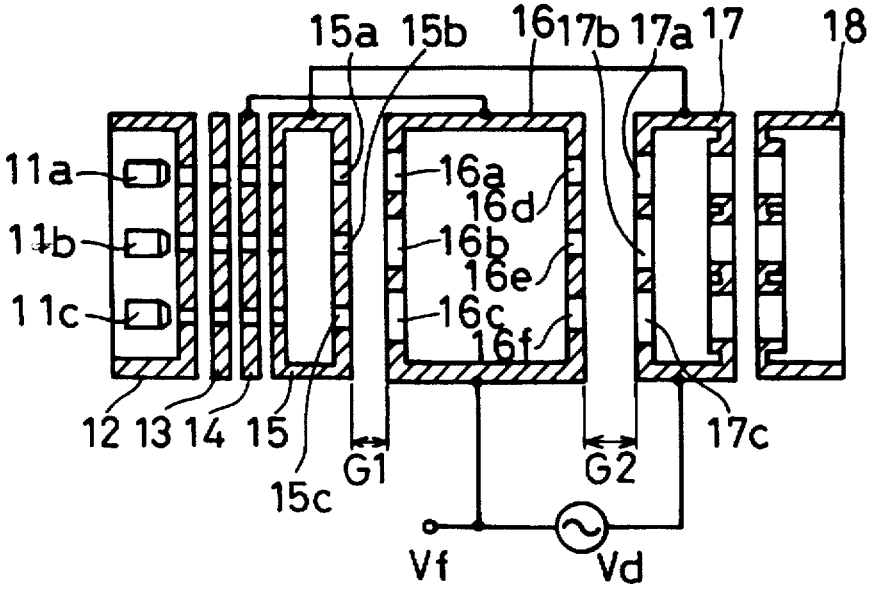
FIG. 22 (PRIOR ART)
FIG. 22 is the cross-sectional plan view showing the configuration of the second conventional in-line electron gun.
Figure 23A:
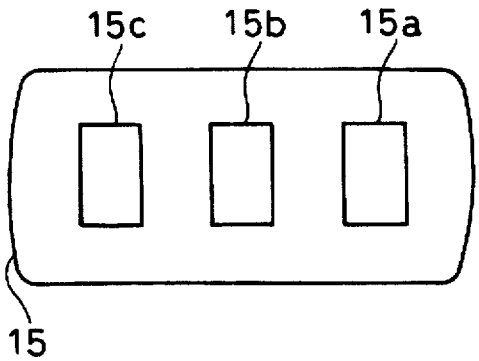
FIG.23(a) (PRIOR ART)
FIG. 23(*a*) is the plan view showing the configuration of the end face of the second auxiliary electrode facing the first focusing electrode in the second conventional in-line electron gun.
Figure 23:
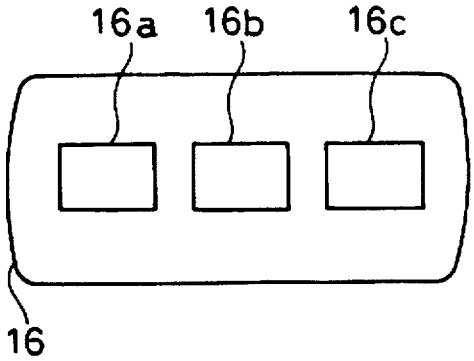
FIG.23 (b) (PRIOR ART)
Figure 23C:
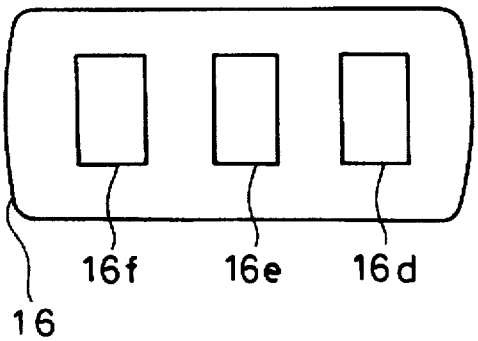
FIG.23(c) (PRIOR ART)
Figure 23D:
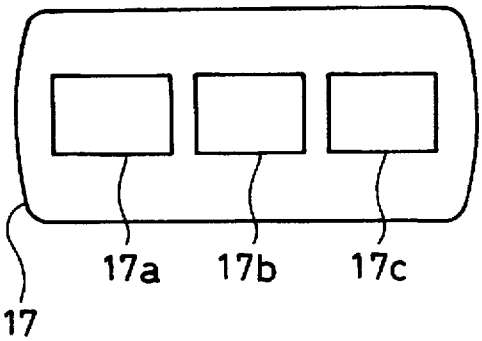
FIG.23(d) (PRIOR ART)

The second embodiment is an improvement of the aforementioned second conventional in-line electron gun shown in FIG. 22 by applying the subject matter of this invention. The second embodiment of the in-line electron gun for the color picture tube of this invention is different from the second conventional in-line electron gun at the points described below.

Figure 15:
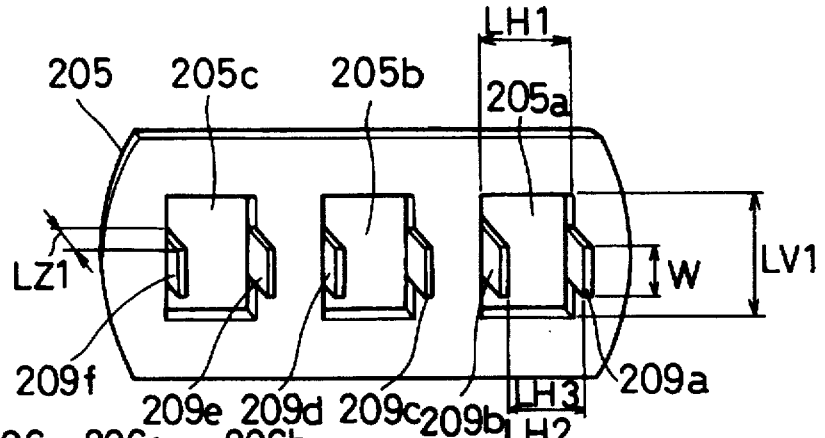
FIG. 15(*a*) is a perspective view showing a configuration of an end face of a second auxiliary electrode facing a first focusing electrode in the second embodiment.
Figure 15:
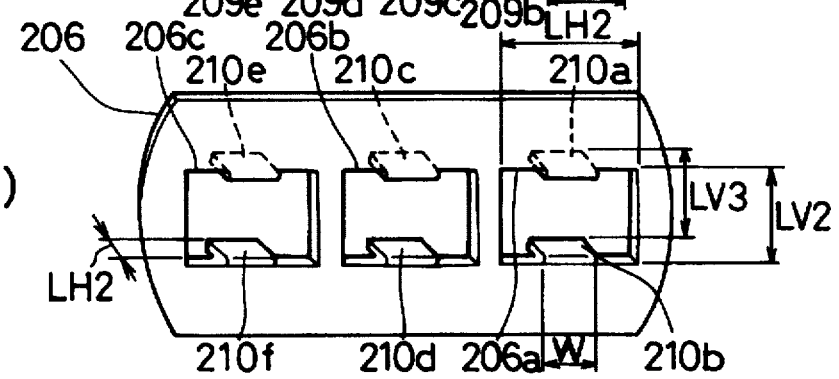
Figure 15:
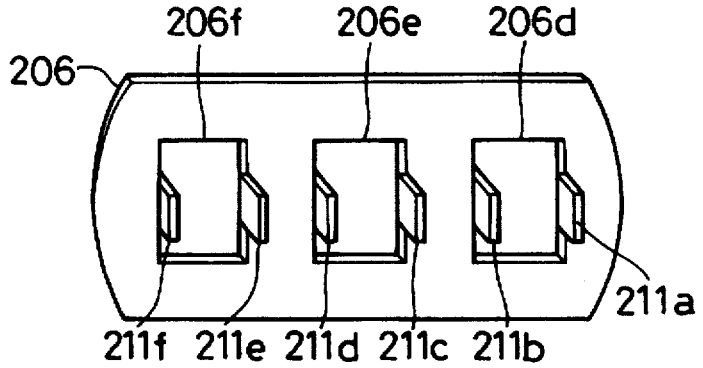
Figure 15:
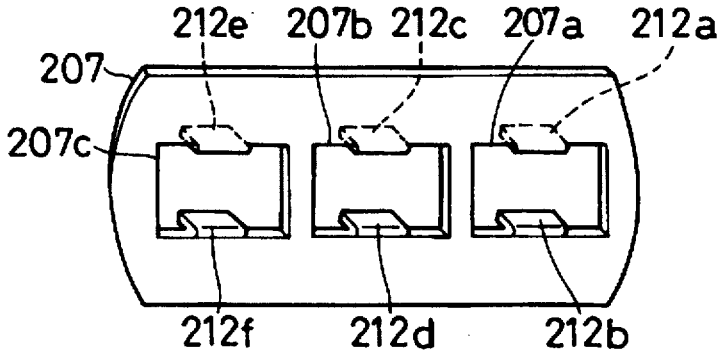

As shown in FIG. 15(*a*), three in-line arranged electron beam through holes 205*a*, 205*b* and 205*c*, which have vertically oblong rectangular shapes, are provided on an end face of the second auxiliary electrode 205 facing the first focusing electrode 206, and protrusions 209*a* to 209*f* are respectively formed on longer sides of the electron beam through holes 205*a* to 205*c* by bending a plate of the end face of the second auxiliary electrode 205. As shown in FIG. 15(*b*), three in-line arranged electron beam through holes 206*a*, 206*b* and 206*c*, which have horizontally oblong rectangular shapes, are provided on an end face of the first focusing electrode 206 facing the second auxiliary electrode 205, and protrusions 210*a* to 210*f* are respectively formed on longer sides of the electron beam through holes 206*a* to 206*c* by bending a plate of the end face of the first focusing electrode 206. As shown in FIG. 15(*c*), three in-line arranged electron beam through holes 206*d*, 206*e* and 206*f*, which have vertically oblong rectangular shapes, are provided on an end face of the first focusing electrode 206 facing the second focusing electrode 207, and protrusions 211*a* to 211*f* are respectively formed on longer sides of the electron beam through holes 206*d* to 206*f* by bending a plate of the end face of the first focusing electrode 206. As shown in FIG. 15(*d*), three in-line arranged electron beam through holes 207*a*, 207*b* and 207*c*, which have horizontally oblong rectangular shapes, are provided on an end face of the second focusing electrode 207 facing the first focusing electrode 206, and protrusions 212*a* to 212*f* are respectively formed on longer sides of the electron beam through holes 207*a* to 207*c* by bending a plate of the end face of the second focusing electrode 207.

Furthermore, as shown in FIG. 14, a distance "G1" between the end faces of the second auxiliary electrode 205 and the first focusing electrode 206 and a distance "G2" between the end faces of the first and second focusing electrodes 206 and 207 are made wider than those in the afore-mentioned second conventional in-line electron gun shown in FIG. 22.

Since the shapes of the electron beam through holes are rectangular and the protrusions are provided in the vicinity of the longer sides of the electron beam through holes, two steps of the quadrupole fields are respectively generated, i.e. between the second auxiliary electrode 205 and the first focusing electrode 206 and between the first focusing electrode 206 and the second focusing electrode 207. The quadrupole fields generated between the second auxiliary electrode 205 and the first focusing electrode 206 are horizontally divergent and vertically convergent. On the other hand, the quadrupole fields generated between the first focusing electrode 206 and the second focusing electrode 207 are horizontally convergent and vertically divergent. Namely, the quadrupole fields generated between the second auxiliary electrode 205 and the first focusing electrode 206 and the quadrupole fields generated between the first focusing electrode 206 and the second focusing electrode 207 respectively act on the opposite actions. However, the fundamental characteristics of both quadrupole fields are substantially the same. The action of the quadrupole fields is described referring to the following example data. The analysis was based on the calculation. With respect to the relation of a width of each protrusion and an intensity of the quadrupole field (a diameter of the electron beam which is received by the lens action of the quadrupole field in a horizontal direction against a diameter of the electron beam in a vertical direction), this is similar to that in the case shown in FIG. 5, even though the action of the quadrupole field is opposed, because the direction of the application of the voltage is opposed.

Common Data:

Focusing voltage Vf=7.56 kV

Dynamic voltage Vd=700 V

Data of the second embodiment:

Sizes of the electron beam through holes;

LH1=1.68 mm

LV1=3.40 mm

LH2=3.40 mm

LV2=1.68 mm

Protrusions;

LH3=1.2 mm

LV3=1.2 mm

LZ1=0.36 mm

LZ2=0.36 mm

Distance between both electrodes;

G=1.44 mm

Data of the second conventional in-line electron gun:

Sizes of the electron beam through holes;

LH1=1.20 mm

LV1=3.40 mm

LH2=3.40 mm

LV2=1.20 mm

Distance between both electrodes;

G=0.48 mm

In the above-mentioned example, perspective electron beam through holes, which were formed by the electron beam through holes 205*a* to 205*c* on the end face of the second auxiliary electrode 205 facing the first focusing electrode 206 and the electron beam through holes 206*a* to 206*c* on the end face of the first focusing electrode 206 facing the second auxiliary electrode 205, had square shapes. The length of each side of the square was 1.68 mm. As can be seen from FIG. 5 which was described in the afore-mentioned first embodiment, when the width of the protrusion was set in a range from 0.34 to 1.68 mm, and especially set at 0.77 mm, the intensity of the quadrupole field becomes the largest. The range of 0.34 to 1.68 mm corresponds to 0.2 to 1.0 times as long as the length (1.68 mm) of the side of the perspective square.

Figure 16:
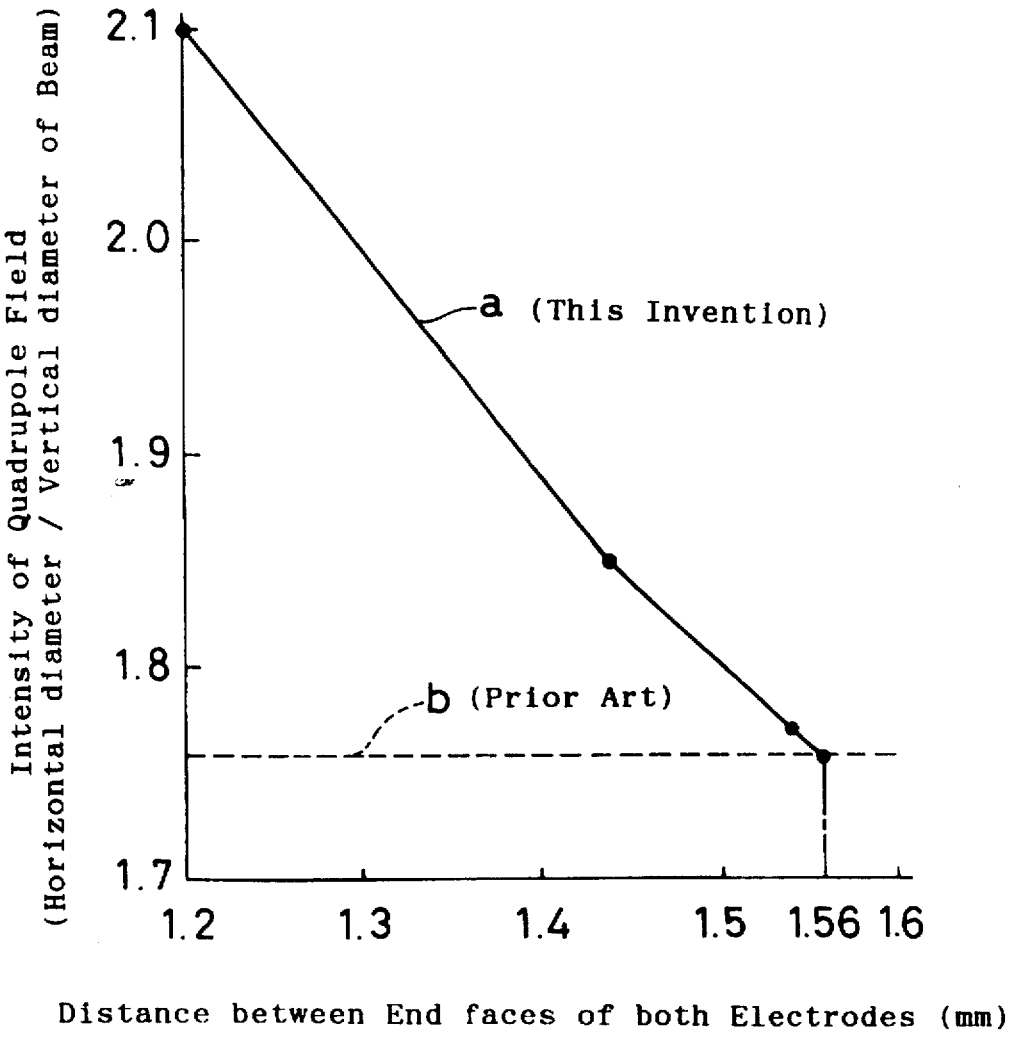
FIG. 16 is a graph showing a relation of a distance between the end face faces of the second auxiliary electrode and the first focusing electrode to intensity of quadrupole fields in the second embodiment.

Therefore, when the width W of the protrusions was set at 0.77 mm, a relation of a distance G between the second auxiliary electrode 205 and the first focusing electrode 206 to an intensity of the quadrupole field was measured. The result is shown in FIG. 16. As can be seen from FIG. 16, when the distance G between the second auxiliary electrode 205 and the first focusing electrode 206 was 1.56 mm, an intensity of the quadrupole field which was substantially the same as that in the conventional electron gun could be obtained. In other words, when the distance G between the second auxiliary electrode 205 and the first focusing electrode 206 is expanded from 0.48 mm to 1.56 mm, substantially the same intensity of the quadrupole field can be obtained. As a result, the electrostatic capacitance between the second auxiliary electrode 205 and the first focusing electrode 206 can be reduced drastically.

Figure 17:
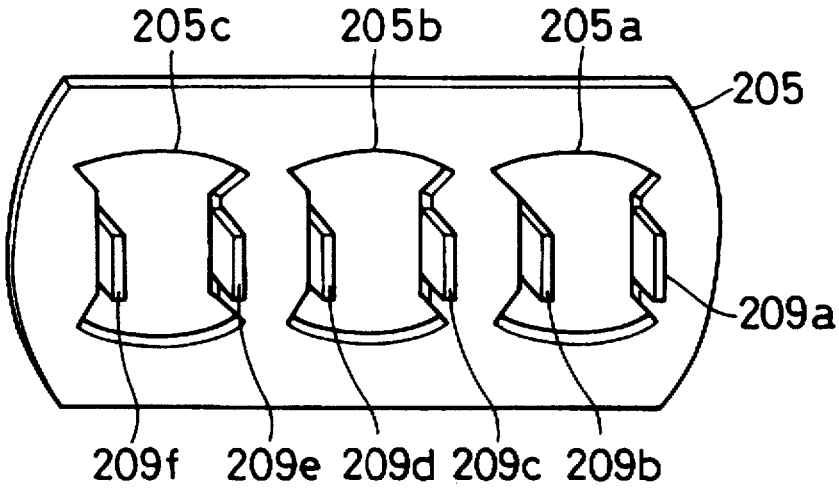
FIG. 17(*a*) is a perspective view showing another configuration of an end face of a second auxiliary electrode facing a first focusing electrode in the second embodiment.
Figure 17:
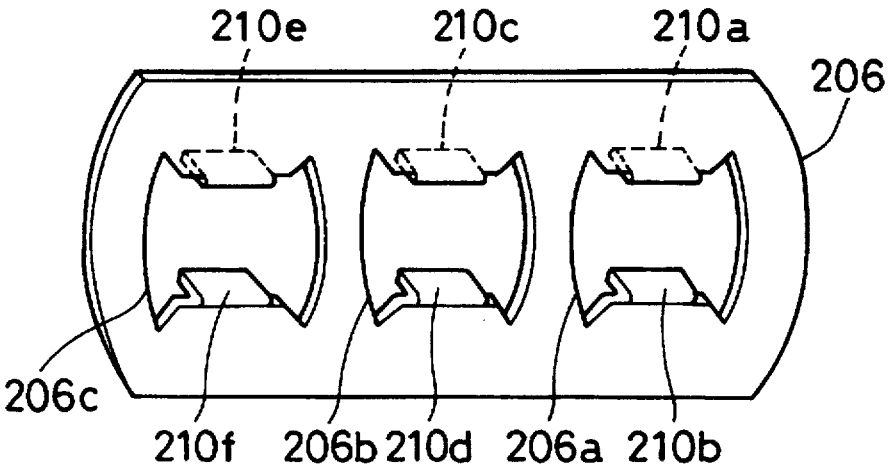

As the protrusions 209*a* to 209*f* on the second auxiliary electrode 205 and/or the protrusions 210*a* to 210*f* on the first focusing electrode 206, plate members can be welded on the end faces of the second auxiliary electrode 205 and/or the first focusing electrode 206 as shown in FIGS. 6(*a*) and 6(*b*) or FIGS. 7(*a*) and 7(*b*). Alternatively, the shape of each electron beam through hole can be made a deformed octagon in which the four corners are cut along the longer sides as shown in FIGS. 10(*a*) and 10(*b*) or FIGS. 17(*a*) and 17(*b*). By cutting the four corners, the electric field can be intensified at the corners. A quadrupole field, which is more intensive than that generated by the rectangular shaped electron beam through holes, can be generated by the deformed octagonal electron beam through holes. Alternatively, the rectangular shaped electron beam through holes and the deformed octagonal electron beam through holes can be combined. Furthermore, with respect to the protrusions 211*a* to 211*f* formed on the first focusing electrode 206 and the protrusions 212*a* to 212*f* on the second focusing electrode, the above-mentioned deformation can be applied.

Figure 18:
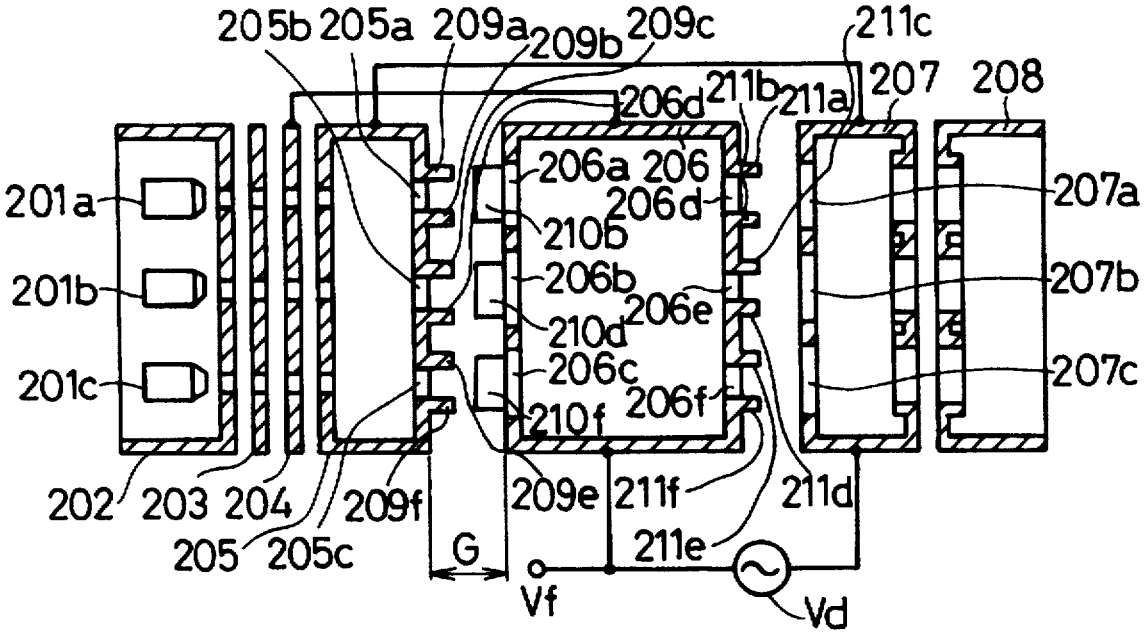
FIG. 18 is a cross-sectional plan view showing another configuration in the second embodiment of the in-line electron gun in the color picture tube of this invention.
Figure 19:
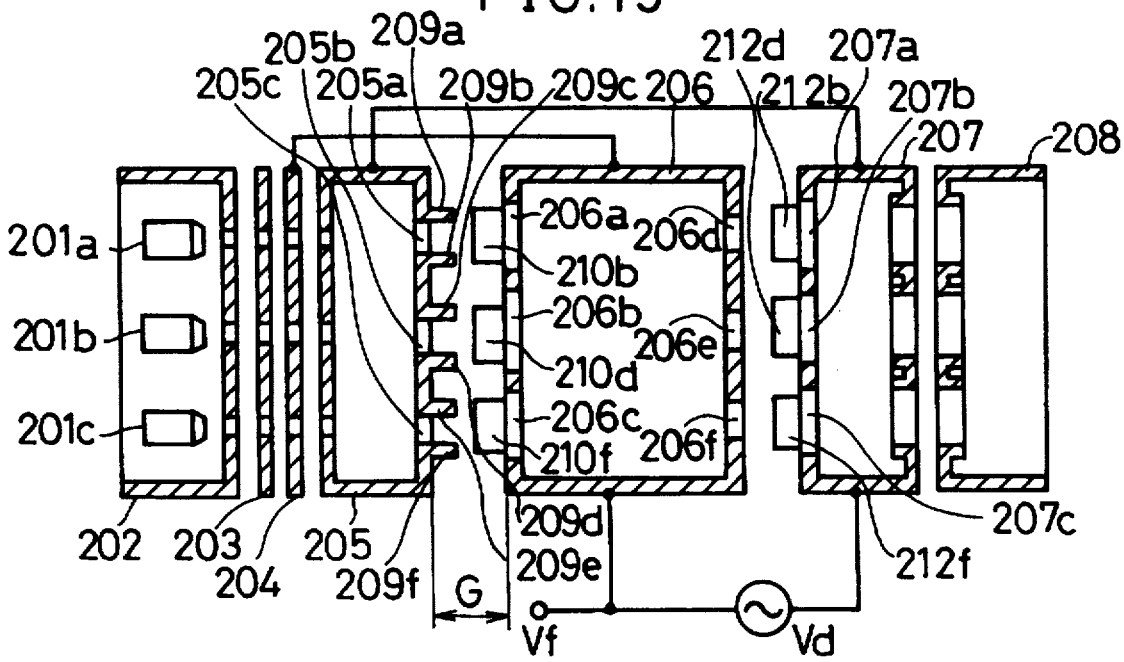
FIG. 19 is a cross-sectional plan view showing still another configuration in the second embodiment of the in-line electron gun in the color picture tube of this invention.
Figure 20:
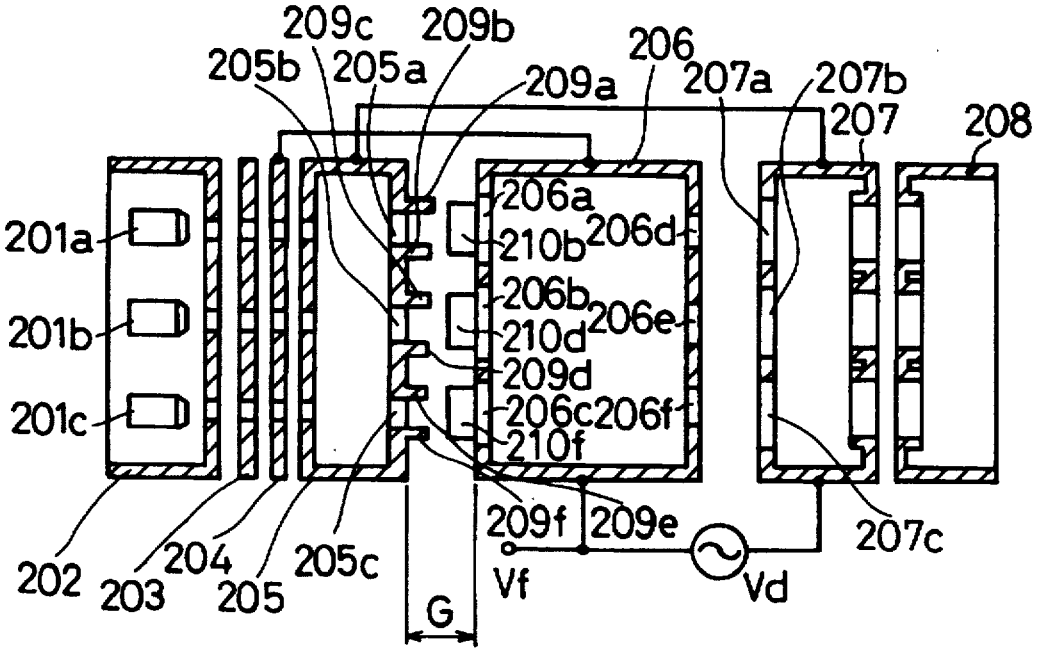
FIG. 20 is a cross-sectional plan view showing still another configuration in the second embodiment of the in-line electron gun in the color picture tube of this invention.
Figure 21:
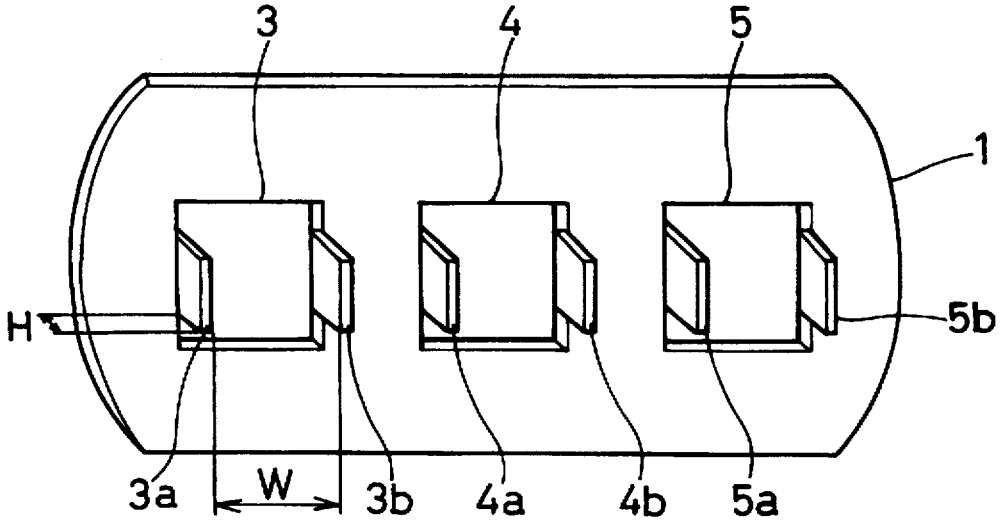
FIG. 21 (a) (PRIOR ART)
FIG. 21(*a*) is the perspective view showing the end face of the first focusing electrode facing the second focusing electrode in the first conventional in-line electron gun.
Figure 21:
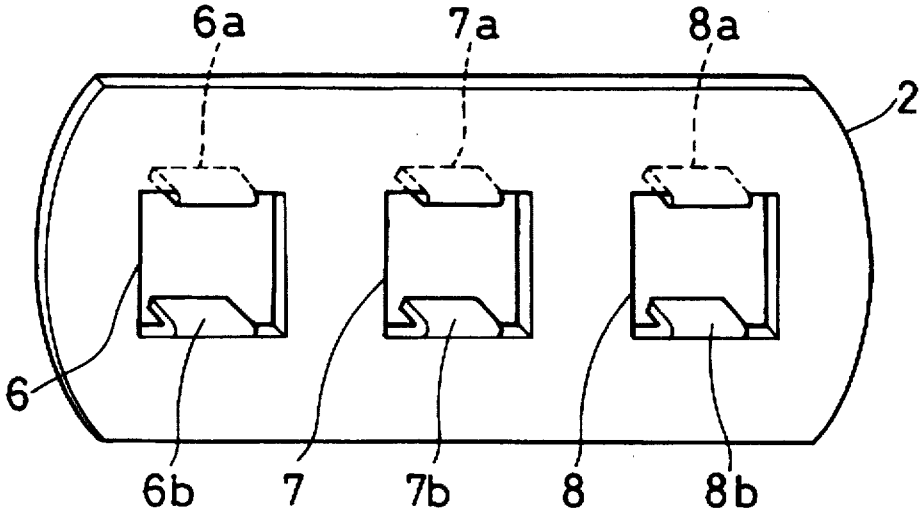
FIG. 21 (b) (PRIOR ART)

Other configurations of the in-line electron gun of the second embodiment are shown in FIGS. 18 to 20. FIG. 18 shows an example in which no protrusion is provided on the end face of the second focusing electrode 207 facing the first focusing electrode 206, but the three sets of the protrusions 211*a* to 211*f* provided on the end face of the first focusing electrode 206 facing the second focusing electrode 207. FIG. 19 shows another example in which no protrusion is provided on the end face of the first focusing electrode 206 facing the second focusing electrode 207 but the three sets of the protrusions 212*a* to 212*f* provided on the end face of the second focusing electrode 207 facing the first focusing electrode 206. FIG. 20 shows still another example in which no protrusion is provided not only on the end face of the first focusing electrode 206 facing the second focusing electrode 207 but also on the end face of the second focusing electrode 207 facing the first focusing electrode 206.

For generating the quadrupole fields between the first focusing electrode 206 and the second focusing electrode 207, at least one set of the three electron beam through holes formed on the first focusing electrode 206 and the second focusing electrode 207 are of a non-circular shape such as rectangular. The above-mentioned examples shown in FIGS. 18 to 20 operate with substantially the same effects as the second embodiment.

The invention may be embodied in other specific forms without departing from the spirit and scope thereof. The embodiments are to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. A color picture tube comprising a funnel, a panel, a phosphor screen disposed inside of said panel, a shadow mask disposed in the vicinity of said phosphor screen and an in-line electron gun disposed in a neck part of said funnel, and wherein:

said electron gun has three cathodes which are arranged in a horizontal direction, a control electrode, an accelerating electrode, a first focusing electrode, a second focusing electrode and a final accelerating electrode;

three electron beam through holes, which are arranged on an end face of said first focusing electrode facing said second focusing electrode, are formed to have a vertically oblong rectangular shape;

three electron through holes, which are arranged on an end face of said second focusing electrode facing said first focusing electrode, are formed to have a horizontally oblong rectangular shape;

a protrusion is provided in the vicinity of each longer side of each electron beam through hole on end faces of both of said first focusing electrode and said second focusing electrode that face each other, protruding toward the other focusing electrode, the longer side having a length greater than the distance the protrusion extends along the longer side, and a sum of the height of one of the protrusions provided on said first focusing electrode and the height of one of the protrusions provided on the second focusing electrode is less than a distance between said end faces of said first and second focusing electrodes;

a predetermined focusing voltage is applied to said first focusing electrode;

a compound voltage, in which a dynamic voltage which gradually increases corresponding to an increase of deflection angle of electron beams is superimposed on said focusing voltage, is applied to said second focusing electrode.

2. A color picture tube comprising a funnel, a panel, a phosphor screen disposed inside of said panel, a shadow mask disposed in the vicinity of said phosphor screen and an in-line electron gun disposed in a neck part of said funnel, and wherein:

said electron gun has three cathodes which are arranged in a horizontal direction, a control electrode, an accelerating electrode, a first focusing electrode, a second focusing electrode and a final accelerating electrode;

three electron beam through holes, which are arranged on an end face of said first focusing electrode facing said second focusing electrode, are formed to have a vertically oblong rectangular shape;

three electron through holes, which are arranged on an end face of said second focusing electrode facing said first focusing electrode, are formed to have a horizontally oblong rectangular shape;

a protrusion is provided in the vicinity of each longer side of each electron beam through hole on an end face of at least one of said first focusing electrode and said second focusing electrode, and protrudes toward the other focusing electrode, the longer side having a length greater than the distance the protrusion extends along the longer side;

a predetermined focusing voltage is applied to said first focusing electrode; and a compound voltage, in which a dynamic voltage which gradually increases corresponding to an increase of deflection angle of electron beams is superimposed on said focusing voltage, is applied to said second focusing electrode, and wherein the shape of said electron beam through holes on an end face of at least one of said first focusing electrode and said second focusing electrode is a deformed octagon having four acute angles in which four corners are cut along the longer sides of each electron beam through hole.

3. A color picture tube comprising a funnel, a panel, a phosphor screen disposed inside of said panel, a shadow mask disposed in the vicinity of said phosphor screen and an in-line electron gun disposed in a neck part of said funnel, and wherein:

said electron gun has three cathodes which are arranged in a horizontal direction, a control electrode, an accelerating electrode, a first focusing electrode, a second focusing electrode and a final accelerating electrode;

three electron beam through holes, which are arranged on an end face of said first focusing electrode facing said second focusing electrode, are formed to have a vertically oblong rectangular shape;

three electron through holes, which are arranged on an end face of said second focusing electrode facing said first focusing electrode, are formed to have a horizontally oblong rectangular shape;

a rectangular tube is provided in the vicinity of each electron beam through hole on end faces of both of said first focusing electrode and said second focusing electrode that face each other, protruding toward the other focusing electrode and enclosing respective sides of said electron through hole, and a sum of the heights of said rectangular tubes provided for one through hole on said first and second focusing electrodes is less than a distance between said end faces of said first and second focusing electrodes;

a predetermined focusing voltage is applied to said first focusing electrode;

a compound voltage, in which a dynamic voltage which gradually increases corresponding to an increase of deflection angle of electron beams is superimposed on said focusing voltage, is applied to said second focusing electrode.

4. A color picture tube comprising a funnel, a panel, a phosphor screen disposed inside of said panel, a shadow mask disposed in the vicinity of said phosphor screen and an in-line electron gun disposed in a neck part of said funnel, and wherein:

said electron gun has three cathodes which are arranged in a horizontal direction, a control electrode, an accelerating electrode, a first focusing electrode, a second focusing electrode and a final accelerating electrode;

three electron beam through holes, which are arranged on an end face of said first focusing electrode facing said second focusing electrode, are formed to have a vertically oblong rectangular shape;

three electron beam through holes, which are arranged on an end face of said second focusing electrode facing said first focusing electrode, are formed to have a horizontally oblong rectangular shape;

a rectangular tube is provided in the vicinity of each electron beam through hole on an end face of at least one of said first focusing electrode and said second focusing electrode, protruding toward the other focusing electrode and enclosing respective side of said electron beam through hole;

a predetermined focusing voltage is applied to said first focusing electrode; and a compound voltage, in which a dynamic voltage which gradually increases corresponding to an increase of deflection angle of electron beams is superimposed on said focusing voltage, is applied to said second focusing electrode, and wherein the shape of said electron beam through holes on an end face of at least one of said first focusing electrode and said second focusing electrode is a deformed octagon having four acute angles in which four corners are cut along the longer sides of each electron beam through hole.

5. An in-line electron gun comprising three cathodes which are arranged in a horizontal direction, a control electrode, an accelerating electrode, a first focusing electrode, a second focusing electrode and a final accelerating electrode, and wherein:

three electron beam through holes, which are arranged on an end face of said first focusing electrode facing said second focusing electrode, are formed to have a vertically oblong rectangular shape;

three electron beam through holes, which are arranged on an end face of said second focusing electrode facing said first focusing electrode, are formed to have a horizontally oblong rectangular shape; and a protrusion is provided in the vicinity of each longer side of each electron beam through hole on end faces of said first focusing electrode and said second focusing electrode that face each other, protruding toward the other focusing electrode, the longer side having a length greater than the distance the protrusion extends along the longer side, and a sum of the height of one of said protrusions provided on said first focusing electrode and the height of one of said protrusions provided on the second focusing electrode is less than a distance between said end faces of said first and second focusing electrodes.

6. An in-line electron gun comprising three cathodes which are arranged in a horizontal direction, a control electrode, an accelerating electrode, a first focusing electrode, a second focusing electrode and a final accelerating electrode, and wherein:

three electron beam through holes, which are arranged on an end face of said first focusing electrode facing said second focusing electrode, are formed to have a vertically oblong rectangular shape;

three electron beam through holes, which are arranged on an end face of said second focusing electrode facing said first focusing electrode, are formed to have a horizontally oblong rectangular shape; and a protrusion is provided in the vicinity of each longer side of each electron beam through hole on an end face of at least one of said first focusino electrode and said second focusing electrode, and protrudes toward the other focusing electrode, the longer side having a length greater than the distance the protrusion extends along the longer side, and wherein the shape of said electron beam through holes on an end face of at least one of said first focusing electrode and said second focusing electrode are a deformed octagon having four acute angles in which four corners are cut along the longer sides of each electron beam through hole.

7. An in-line electron gun comprising three cathodes which are arranged in a horizontal direction, a control electrode, an accelerating electrode, a first focusing electrode, a second focusing electrode and a final accelerating electrode; and wherein:

three electron beam through holes, which are arranged on an end face of said first focusing electrode facing said second focusing electrode, are formed to have a vertically oblong rectangular shape;

three electron beam through holes, which are arranged on an end face of said second focusing electrode facing said first focusing electrode, are formed to have a horizontally oblong rectangular shape; and a rectangular tube is provided in the vicinity of each electron beam through hole on end faces of one both of said first focusing electrode and said second focusing electrode that face each other, protruding toward the other focusing electrode and enclosing respective sides of said electron through hole, and a sum of the heights of said rectangular tubes provided for one through hole on said first and second focusing electrodes is less than a distance between said end faces of said first and second focusing electrodes.

8. An in-line electron gun comprising three cathodes which are arranged in a horizontal direction, a control electrode, an accelerating electrode, a first focusing electrode, a second focusing electrode and a final accelerating electrode, and wherein:

three electron beam through holes, which are arranged on an end face of said first focusing electrode facing said second focusing electrode, are formed to have a vertically oblong rectangular shape;

three electron beam through holes, which are arranged on an end face of said second focusing electrode facing said first focusing electrode, are formed to have a horizontally oblong rectangular shape; and a rectangular tube is provided in the vicinity of each electron beam through hole on an end face of at least one of said first focusing electrode and said second focusing electrode, protruding toward the other focusing electrode and enclosing respective sides of said electron beam through hole, and wherein the shape of said electron beam through holes on an end face of at least one of said first focusing electrode and said second focusing electrode is a deformed octagon having four acute angles in which four corners are cut along the longer sides of each electron beam through hole.

9. A color picture tube comprising a funnel, a panel, a phosphor screen disposed inside of said panel, a shadow mask disposed in the vicinity of said phosphor screen and an in-line electron gun disposed in a neck part of said funnel, and wherein:

said electron gun has three cathodes which are arranged in a horizontal direction, a control electrode, an accelerating electrode, a first auxiliary electrode, a second auxiliary electrode, a first focusing electrode, a second focusing electrode and a final accelerating electrode;

at least one group of three electron beam through holes, which are arranged on end faces of said first focusing electrode and said second focusing electrode which oppose each other, are formed to have a non-circular shape for generating quadrupole fields between said first focusing electrode and said second focusing electrode;

three electron through holes, which are arranged on an end face of said second auxiliary electrode facing said first focusing electrode, are formed to have a vertically oblong noncircular shape;

three electron through holes, which are arranged on an end face of said first focusing electrode facing said second auxiliary electrode, are formed to have a horizontally oblong non-circular shape;

a protrusion is provided in the vicinity of each longer side of each electron beam through hole on both of the end face of said first focusing electrode facing said second auxiliary electrode and the end face of said second auxiliary electrode facing said first focusing electrode, protruding toward said other electrode, the longer side having a length greater than the distance the protrusion extends along the longer side, and a sum of the height of one of said protrusions provided on said first focusing electrode and the height of one of said protrusions on said second auxiliary electrode is less than a distance between said end face of said first focusing electrodes and said end face of said second auxiliary electrode;

said first auxiliary electrode and said first focusing electrode are connected, and a predetermined focusing voltage is applied to them; and said second auxiliary electrode and said second focusing electrode are connected and a compound voltage, in which a dynamic voltage which gradually increases corresponding to an increase of deflection angle of electron beams is superimposed on said focusing voltage, is applied to them.

10. The color picture tube in accordance with claim 9, wherein three electron beam through holes on an end face of said first focusing electrode facing said second focusing electrode are formed to have a vertically oblong non-circular shape; three electron beam through holes on an end face of said second focusing electrode facing said first focusing electrode are formed to have a horizontally oblong non-circular shape; and a protrusion is provided in the vicinity of each longer side of each electron beam through hole on at least one of said end faces of said first focusing electrode and said second focusing electrodes, protruding toward the other focusing electrode.

11. A color picture tube comprising a funnel, a panel, a phosphor screen disposed inside of said panel, a shadow mask disposed in the vicinity of said phosphor screen and an in-line electron gun disposed in a neck part of said funnel, and wherein:

said electron gun has three cathodes which are arranged in a horizontal direction, a control electrode, an accelerating electrode, a first auxiliary electrode, a second auxiliary electrode, a first focusing electrode, a second focusing electrode and a final accelerating electrode;

at least one group of three electron beam through holes which are arranged on end faces of said first focusing electrode and said second focusing electrode which oppose each other, are formed to have a non-circular shape for generating quadrupole fields between said first focusing electrode and said second focusing electrode;

three electron through holes, which are arranged on an end face of said second auxiliary electrode facing said first focusing electrode, are formed to have a vertically oblong non-circular shape;

three electron through holes, which are arranged on an end face of said first focusing electrode facing said second auxiliary electrode, are formed to have a horizontally oblong noncircular shape:

a protrusion is provided in the vicinity of each longer side of each electron beam through hole on at least one of the end face of said first focusing electrode facing said second auxiliary electrode and the end face of said second auxiliary electrode facing said first focusing electrode, and protrudes towards said other electrode, the longer side having a length greater than the distance the protrusion extends along the longer side;

said first auxiliary electrode and said first focusing electrode are connected, and a predetermined focusing voltage is applied to them; and said second auxiliary electrode and said second focusing electrode are connected and a compound voltage, in which a dynamic voltage which gradually increases corresponding to an increase of deflection angle of electron beams is superimposed on said focusing voltage, is applied to them, and wherein the shapes of said noncircular electron beam through holes are substantially rectangular or a deformed octagon having four acute angles in which four corners are cut along the longer sides.

12. An in-line electron gun comprising three cathodes which are arranged in a horizontal direction, a control electrode, an accelerating electrode, a first auxiliary electrode, a second auxiliary electrode, a first focusing electrode, a second focusing electrode and a final accelerating electrode, and wherein:

at least one group of three electron beam through holes, which are arranged on end faces of said first focusing electrode and said second focusing electrode which oppose each other, are formed to have a non-circular shape for generating quadrupole fields between said first focusing electrode and said second focusing electrode;

three electron through holes, which are arranged on an end face of said second auxiliary electrode facing said first focusing electrode, are formed to have a vertically oblong noncircular shape;

three electron through holes, which are arranged on an end face of said first focusing electrode facing said second auxiliary electrode, are formed to have a horizontally oblong non-circular shape; and a protrusion is provided in the vicinity of each longer side of each electron beam through hole on both of the end face of said first focusing electrode facing said second auxiliary electrode and the end face of said second auxiliary electrode facing said first focusing electrode, protruding toward said other electrode, the longer side having a length greater than the distance the protrusion extends along the longer side, and a sum of the height of one of said protrusions provided on said first focusing electrode and the height of one of said protrusions provided on said second auxiliary electrode is less than a distance between said end face of said first focusing electrodes and said end face of said second auxiliary electrode.

13. The in-line electron gun in accordance with claim 12, wherein three electron beam through holes on an end face of said first focusing electrode facing said second focusing electrode are formed to have a vertically oblong noncircular shape; three electron beam through holes on an end face of said second focusing electrode facing said first focusing electrode are formed to have a horizontally oblong non-circular shape; protrusion is provided in the vicinity of each longer side of each electron beam through hole on at least one of said end faces of said first focusing electrode and said second focusing electrodes, protruding toward the other electrode.

14. An in-line electron gun comprising three cathodes which are arranged in a horizontal direction, a control electrode, an accelerating electrode, a first auxiliary electrode a second auxiliary electrode, a first focusing electrode a second focusing electrode and a final accelerating electrode, and wherein:

at least one group of three electron beam through holes, which are arranged on end faces of said first focusing electrode and said second focusing electrode which oppose each other, are formed to have a non-circular shape for generating quadrupole fields between said first focusing electrode and said second focusing electrode;

three electron through holes, which are arranged on an end face of said second auxiliary electrode facing said first focusing electrode, are formed to have a vertically oblong non-circular shape;

three electron through holes, which are arranged on an end face of said first focusing electrode facing said second auxiliary electrode, are formed to have a horizontally oblong noncircular shape; and a protrusion is provided in the vicinity of each longer side of each electron beam through hole on an end face of at least one of said first focusing electrode facing said second auxiliary electrode and said second auxiliary electrode facing said first focusing electrode, and are protruded toward the other electrode, the longer side having a length greater than the distance the protrusion extends along the longer side, and wherein the shapes of said non-circular electron beam through holes are substantially rectangular or a deformed octagon having four acute angles in which four corners are cut along said oblong sides.

* * * * *